US009573410B2

(12) United States Patent
Aizawa et al.

(10) Patent No.: US 9,573,410 B2
(45) Date of Patent: Feb. 21, 2017

(54) WRITING UTENSIL

(71) Applicant: ZEBRA CO., LTD., Tokyo (JP)

(72) Inventors: Yoshitoshi Aizawa, Tokyo (JP); Shigeo Abe, Tokyo (JP); Yukihiro Tsukioka, Tokyo (JP); Shouhei Moriyasu, Aichi (JP)

(73) Assignee: ZEBRA CO., LTD., Tokyo (JP)

( * ) Notice: Subject to any disclaimer, the term of this patent is extended or adjusted under 35 U.S.C. 154(b) by 81 days.

(21) Appl. No.: 14/801,945

(22) Filed: Jul. 17, 2015

(65) Prior Publication Data

US 2016/0039243 A1 Feb. 11, 2016

(30) Foreign Application Priority Data

Aug. 6, 2014 (JP) ..... 2014-160738
Aug. 6, 2014 (JP) ..... 2014-160739

(51) Int. Cl.

| | |
|---|---|
| ***B43K 21/22*** | (2006.01) |
| ***B43K 21/02*** | (2006.01) |
| ***B43K 21/027*** | (2006.01) |
| ***B43K 7/12*** | (2006.01) |
| ***B43K 8/24*** | (2006.01) |
| ***B43K 5/16*** | (2006.01) |
| ***B65H 37/00*** | (2006.01) |

(52) U.S. Cl.

CPC ..... *B43K 21/02* (2013.01); *B43K 5/16* (2013.01); *B43K 7/12* (2013.01); *B43K 8/24* (2013.01); *B43K 21/027* (2013.01); *B43K 21/22* (2013.01); *B65H 37/007* (2013.01)

(58) Field of Classification Search

CPC ..... B43K 21/02; B43K 21/22; B43K 21/027
USPC ..... 401/92
See application file for complete search history.

(56) References Cited

U.S. PATENT DOCUMENTS 8,920,057 B2 * 12/2014 Noguchi ..... B43K 21/02 401/65
9,180,722 B2 * 11/2015 Hosoya ..... B43K 21/02

FOREIGN PATENT DOCUMENTS

| | | |
|---|---|---|
| JP | 63-180283 | 11/1988 |
| JP | 2003-54184 | 2/2003 |
| JP | 2008-126596 | 6/2008 |
| JP | 2010-94954 | 4/2010 |
| JP | 2010-201813 | 9/2010 |

* cited by examiner

*Primary Examiner* — Jennifer C Chiang
(74) *Attorney, Agent, or Firm* — Greenblum & Bernstein, P.L.C.

(57) ABSTRACT

To protect a writing core, a writing utensil includes: a shaft tube; a holder which is inserted through a front opening of a shaft tube and protrudes forward from a front end of the shaft tube; a writing core which is inserted through the holder while coming into contact with an inner peripheral surface of the holder and is supported by the shaft tube so as to protrude forward from a front end of the holder; and a movement direction conversion mechanism which is provided between the shaft tube and the holder and moves the holder forward relative to the shaft tube and the writing core by a force applied to the holder in the shaft tube outward radial direction.

8 Claims, 14 Drawing Sheets

WRITING UTENSIL

TECHNICAL FIELD

The present invention relates to a writing utensil such as a mechanical pencil, a ballpoint pen, a felt pen, a marker pen, and a correction pen in which a writing portion is made to protrude from a front end of a shaft tube.

RELATED ART

Hitherto, as disclosed in Patent Literature 1, there is known a mechanical pencil including a shaft tube (an outer shaft 1), a holder (a middle shaft 2) which is inserted through a front opening of the shaft tube (the outer shaft 1) and protrudes forward from a front end of the shaft tube (the outer shaft 1), and a writing core (a core guide pipe 5 or the like) which is inserted through a holder (a slider 10) and protrudes forward from a front end of the holder (the slider 10).

Generally, in the above-described mechanical pencil, the shaft tube (the outer shaft 1) is held while being inclined at an appropriate angle and a pencil lead (a core 20) protruding forward is pressed against a paper surface during a writing operation.

For this reason, a pressing force generated in the axial direction and a pressing force generated in a direction intersecting the axial direction are applied to the pencil lead (the core 20). As a result, there is a concern that the pencil lead (the core 20) may be bent by the pressing force.

Further, a problem in which the front portion (the pencil lead or the like) of the writing core (the core guide pipe 5 or the like) protruding from the holder is damaged as described above may arise in a ballpoint pen (particularly a ballpoint pen having a thin needle-shaped tip), a felt pen, a marker pen, or a correction pen as well as the mechanical pencil.

Further, in the above-described related art, there is a concern that an unpleasant operation sound may be generated when the holder (the middle shaft 2) is retracted into the shaft tube (the outer shaft 1) in a non-use state.

Further, as for another related art, as disclosed in Patent Literature 2, there is known a mechanical pencil including a chuck (a core fixing chuck 22) which moves a clipped pencil lead forward and releases the pencil lead, a core breaker (a core holder 32) which holds the pencil lead inserted through the chuck (22) at a front position separated from the chuck (22), a guide pipe (34) which has a front end divided into three pieces and moves forward and backward while covering the outer periphery of the pencil lead between the chuck (22) and the core breaker (32), and a front member (16) which encloses these components.

According to the mechanical pencil, since the core portion in front of the chuck (22) is protected by the guide pipe (34), it is possible to reduce a problem in which the core is bent between the chuck (22) and the core breaker (32).

However, according to the latter related art, the core powder which is generated by the friction with respect to the guide pipe (34) enters while being fixed between the outer periphery of the rear end of the guide pipe (34) and the inner peripheral surface of the front member (16). Thus, there is a concern that an operation error occurs.

Further, since the guide pipe (34) is formed in a shape in which the front end is divided into three pieces, for example, the pencil lead which receives a strong impact such as a dropping impact is jammed in the portion divided into three pieces. Thus, there is a concern that the core may be bent or the operation error may occur.

CITATION LIST

Patent Literature

[Patent Literature 1] Japanese Utility Model Application Publication (JP-U) No. 63-180283

[Patent Literature 2] Japanese Patent Application Laid-Open (JP-A) No. 2003-54184

SUMMARY OF THE INVENTION

The invention is made in view of the above-described circumstances, and an object thereof is to provide a writing utensil capable of protecting a writing core.

In order to solve the above-described problems, provided is a writing utensil including: a shaft tube; a holder which is inserted through a front opening of the shaft tube and protrudes forward from a front end of the shaft tube; a writing core which is inserted through the holder while coming into contact with an inner peripheral surface of the holder and is supported by the shaft tube so as to protrude forward from a front end of the holder; and a movement direction conversion mechanism which is provided between the shaft tube and the holder and moves the holder forward relative to the shaft tube and the writing core by a force applied to the holder in the shaft tube outward radial direction.

Since the invention has the above-described structure, the writing core may be protected.

DETAILED DESCRIPTION OF PREFERRED EMBODIMENTS

Figure 1:
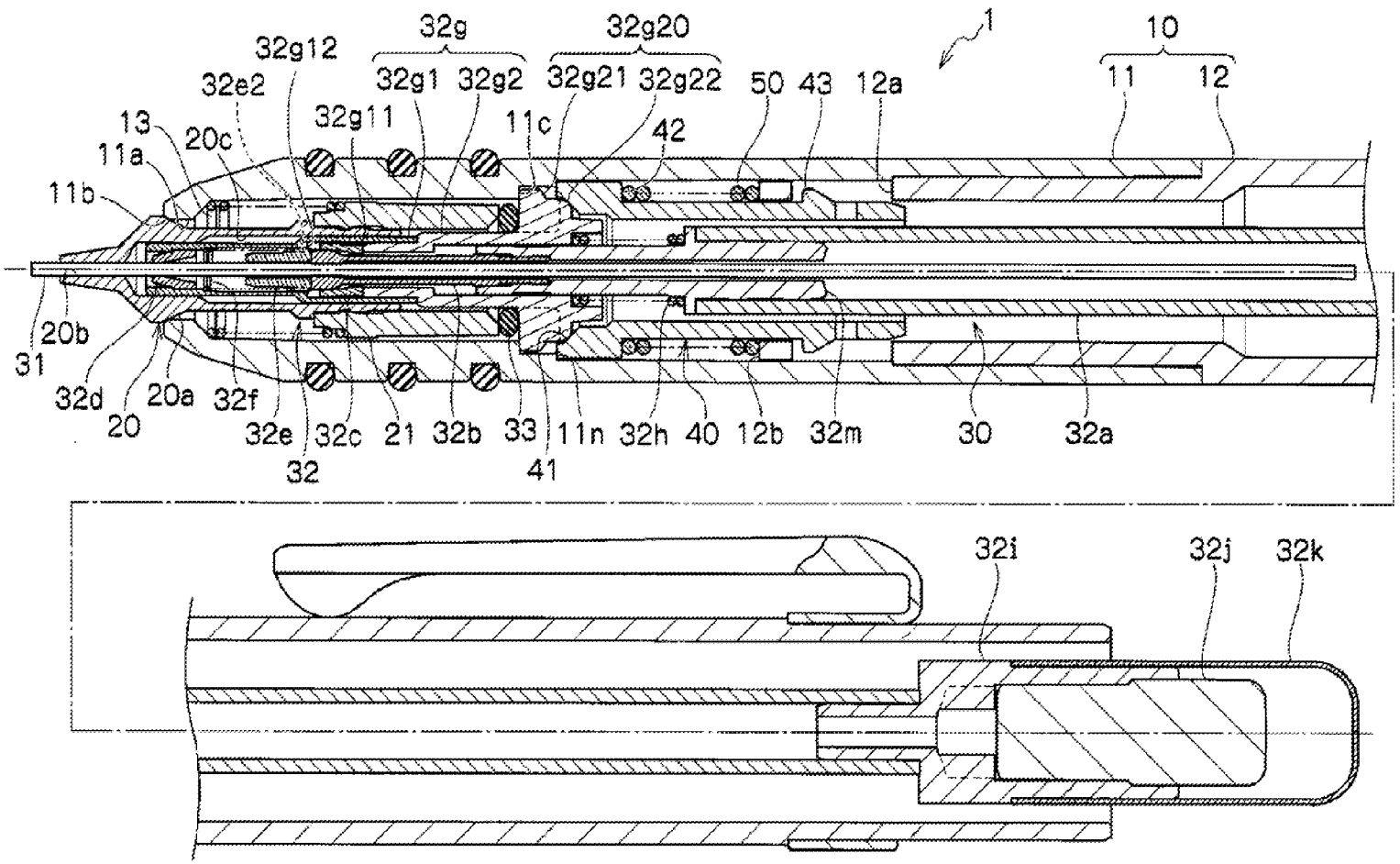
FIG. 1 is a cross-sectional view illustrating an example of a writing utensil according to the invention.

As one feature of the embodiment, a writing utensil includes a shaft tube, a holder which is inserted through a front opening of the shaft tube and protrudes forward from a front end of the shaft tube, and a writing core which is inserted through the holder while coming into contact with an inner peripheral surface of the holder and is supported so as to protrude forward from a front end of the holder, wherein the holder is moved forward and backward relative to the shaft tube, and a buffer material is provided so as to be elastically deformed while receiving the holder moving backward.

According to this structure, when the holder moves backward, the holder is received by the buffer material and the buffer material is elastically deformed. Thus, it is possible to reduce an operation sound generated when the backward moving holder comes into contact with the shaft tube side member.

In addition, as a detailed example of the "writing core", a mechanical pencil writing core (also referred to as a mechanical pencil refill) in which a pencil lead is inserted through a holder and is made to protrude forward from a front end of the holder, a ballpoint pen writing core (a ballpoint pen refill) in which a tip is inserted through a holder and is made to protrude forward from a front end of the holder, a felt pen writing core or a marker pen writing core which is inserted through a holder and in which a writing portion is made to protrude forward from a front end of the holder, or a correction pen writing core may be exemplified.

As another feature, the holder is provided with a protrusion which protrudes toward the rear side of the shaft tube and partially presses the buffer material.

According to this structure, the buffer material may be locally and largely deformed elastically by the protrusion of the backward moving holder, and hence the operation sound may be more effectively reduced.

Further, as another feature, a protrusion which protrudes forward in the axial direction and partially presses the buffer material is provided in a portion which receives the holder through the buffer material.

According to this structure, the buffer material may be locally and largely deformed elastically by the protrusion of the portion receiving the holder, and hence the operation sound may be more effectively reduced.

Further, as another feature, a holder urge member is provided so as to urge the holder backward relative to the shaft tube.

According to this structure, the holder may be moved backward by the urging force of the holder urge member, and hence the contact sound caused by the backward movement may be reduced by the buffer material.

Further, as another feature, the writing core is supported by the shaft tube, and a movement direction conversion mechanism which moves the holder forward relative to the shaft tube and the writing core by a force applied to the holder in the shaft tube outward radial direction is provided between the shaft tube and the holder.

According to this structure, when a force generated in the shaft tube outward radial direction by the writing pressure or the like is applied to a portion protruding from the holder in the writing core and the force is applied to the holder, the holder moves forward relative to the shaft tube and the writing core and covers and protects the front side of the writing core. For this reason, the damage of the writing core may be prevented.

In addition, as a detailed example of the "movement direction conversion mechanism", a structure may be employed in which the movement of the holder in the shaft tube outward radial direction is converted into the movement in the shaft tube forward movement direction by a cam slant face (a slant face) or a structure may be employed in which the movement of the holder in the shaft tube outward radial direction is converted into the movement in the shaft tube forward movement direction by a link member.

Further, as another feature, in the movement direction conversion mechanism, a cam slant face is provided in at least one side of the shaft tube and the holder, the holder engages with the shaft tube so as to be movable forward and backward through the cam slant face, and the cam slant face is slanted to come into slide contact with the other side by the force applied to the holder in the shaft tube outward radial direction so as to move the holder forward.

According to this structure, when a force in the shaft tube outward radial direction is applied to the writing core protruding forward from the holder and the force is applied to the holder, the cam slant face comes into slide contact with the other side and the holder moves forward relative to the writing core.

In addition, a structure in which the "cam slant face is provided at one side of the shaft tube and the holder and the holder engages with the shaft tube through the cam slant face so as to be movable forward and backward" includes a structure in which the cam slant face increased in diameter forward is provided in the outer peripheral surface of the holder and the holder engages with the front opening of the shaft tube through the cam slant face so as to be movable forward and backward, a structure in which the cam slant face increased in diameter forward is provided in the front opening of the shaft tube and the holder engages with the front opening of the shaft tube through the cam slant face so as to be movable forward and backward, and a structure in which the cam slant face increased in diameter backward is provided in the rear end of the holder and the holder engages with the front edge of the shaft tube through the cam slant face so as to be movable forward and backward.

Figure 11A:
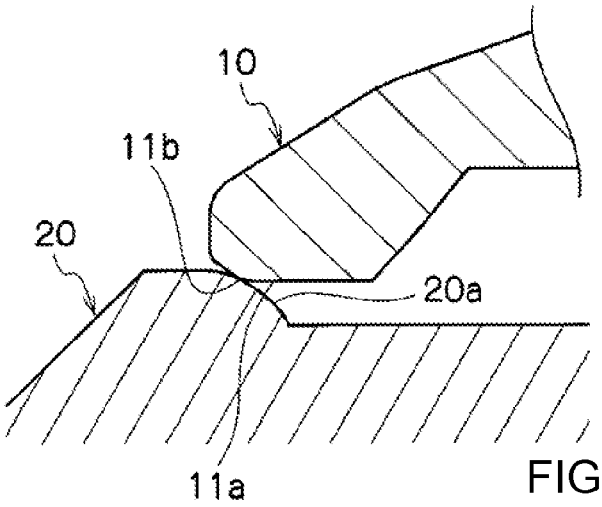
FIGS. 11(*a*) to 11(*c*) are cross-sectional views illustrating modified examples of a cam slant face.
Figure 11B:
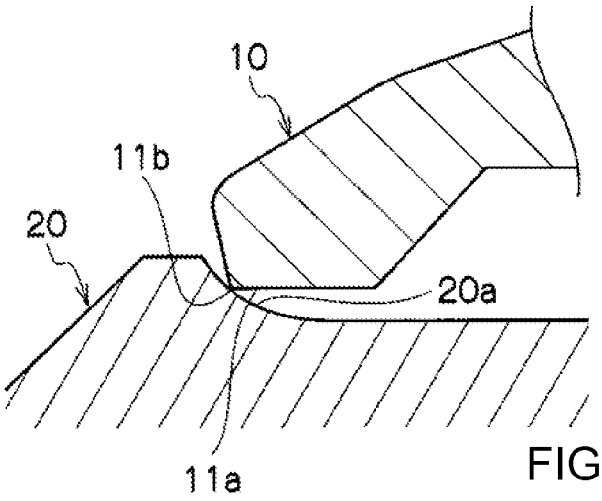
Figure 11C:
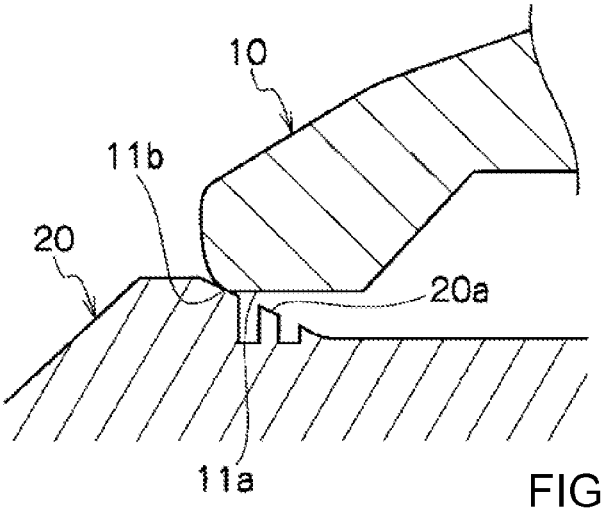

Further, the "cam slant face" includes a straight slant face (see FIG. 8), a convex slant face (see FIG. 11(*a*)), a concave slant face (see FIG. 11(*b*), and an intermittent slant face (see FIG. 11(*c*)).

Further, as another feature, a step portion which is decreased in diameter forward and a writing core support slant face which is increased in diameter forward are provided inside the shaft tube, and a writing core support portion which protrudes in the outward radial direction is provided in the outer periphery of the writing core. Then, the writing core support portion is provided between the step portion and the writing core support slant face inside the shaft tube, and is finely movable backward and in the shaft tube radial direction.

Further, as another feature, the buffer material is provided between the holder and the writing core support portion.

Further, as another feature of the embodiment, the pencil lead delivering mechanism includes a chuck which moves a clipped pencil lead forward and releases the clipped pencil lead and a core breaker which holds the pencil lead inserted through the chuck at a front position separated from the chuck, and the pencil lead is delivered toward the front side of the core breaker by the clipping operation, the releasing operation, and the forward and backward movement operation of the chuck. Further, the pencil lead delivering mechanism includes a sliding cylinder which moves forward and backward while covering the outer periphery of the pencil lead between the chuck and the core breaker and an urge member that urges the sliding cylinder backward relative to the core breaker so that the chuck and the sliding cylinder move forward and backward together. Then, the outer peripheral surface of the sliding cylinder is provided with a core powder escape groove which is pierced in the axial direction.

According to this structure, it is possible to prevent the pencil lead from being bent by a dropping impact or the like between the chuck and the core breaker by the sliding cylinder and, since the core powder generated by the slide of the sliding cylinder escapes in the axial direction of the sliding cylinder by the core powder escape groove, it is possible to prevent a problem in which the core powder is fixed to the periphery of the sliding cylinder so that an operation error occurs.

Further, as another feature, the inner peripheral surface of the sliding cylinder is formed in a cylindrical shape which is continuous in the entire circumference and is near or in contact with the outer peripheral surface of the pencil lead.

According to this structure, since the outer peripheral surface of the sliding cylinder is covered and protected in a cylindrical shape in the entire circumference, a problem in which the core is bent or the pencil lead is abraded hardly occurs compared to, for example, a structure having a groove or an unevenness in the inner peripheral surface of the sliding cylinder.

Further, as another feature, a holding cylinder which encloses the chuck, the core breaker, the urge member, and the sliding cylinder is provided, and the sliding cylinder is moved forward and backward while the outer peripheral surface with the core powder escape groove comes into slide contact with the inner peripheral surface of the holding cylinder.

According to this structure, since it is possible to cause the core powder to escape in the axial direction by the core powder escape groove between the outer peripheral surface of the sliding cylinder and the inner peripheral surface of the holding cylinder, the sliding property of the sliding cylinder with respect to the inner peripheral surface of the holding cylinder is satisfactory.

Further, as another feature, the sliding cylinder includes an enlarged portion of which the rear portion is larger than the front portion, and the core powder escape groove is formed in the outer peripheral surface of the enlarged portion.

According to this structure, it is possible to effectively release the pencil lead in the axial direction by the core powder escape groove.

Further, as another feature, the mechanical pencil includes the pencil lead delivering mechanism with the above-described structure.

Embodiment

Next, preferred embodiments with the above-described features will be described in detail with reference to the drawings.

In the specification, the shaft tube axial direction indicates the extension direction of the axis of the shaft tube. Further, the "front" indicates a direction which moves toward one side of the shaft tube axial direction and the tip of the writing portion. Further, the "rear" indicates a direction opposite to one side of the shaft tube axial direction. Further, the "shaft tube radial direction" indicates a direction perpendicular to the shaft tube axial direction. Further, the "shaft tube outward radial direction" indicates a direction which moves away from the shaft tube axis in the shaft tube radial direction. The "shaft tube inward radial direction" indicates a direction which moves near the shaft tube axis in the shaft tube radial direction.

Figure 2:
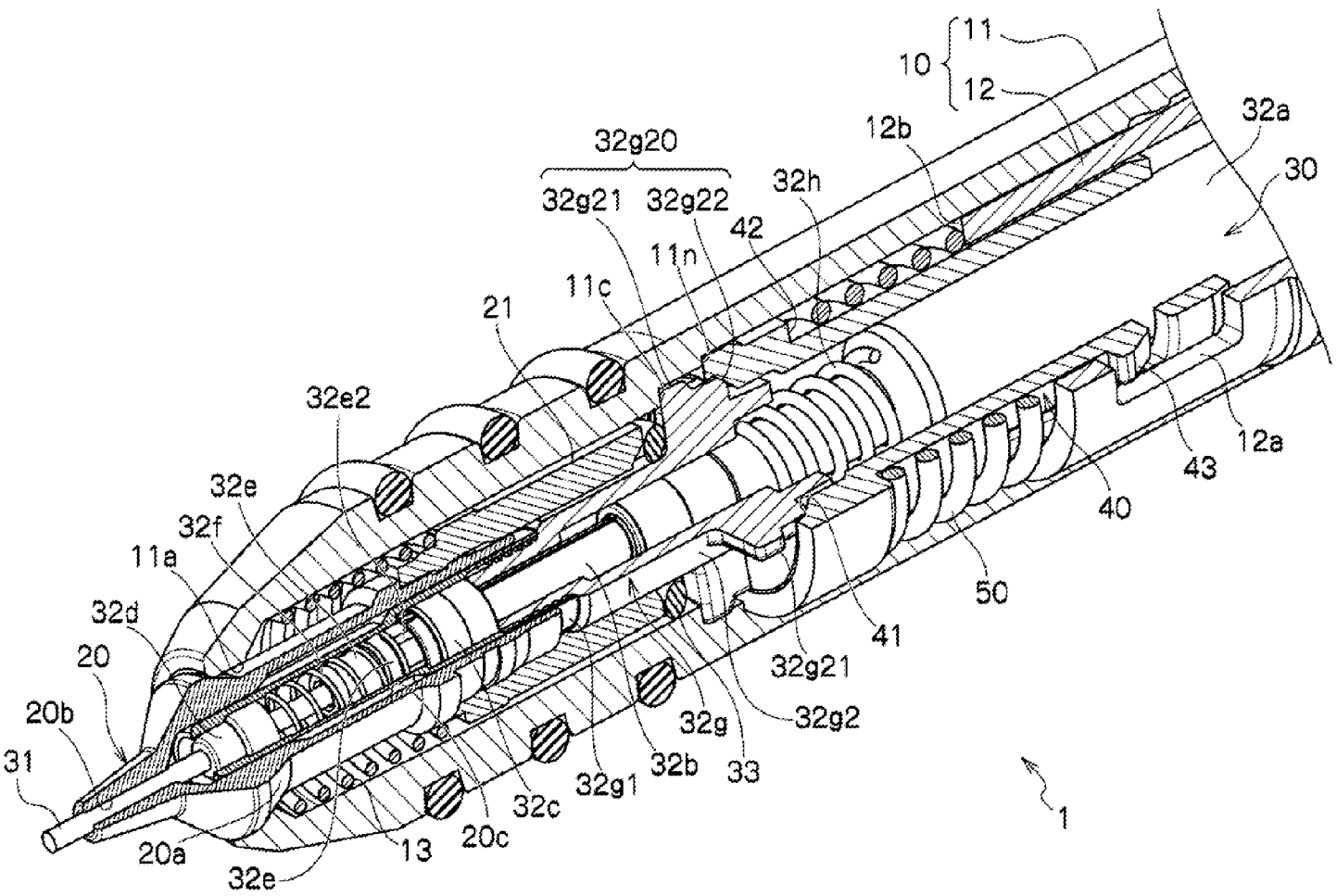
FIG. 2 is an enlarged perspective view illustrating a main part of the writing utensil.

As illustrated in FIGS. 1 and 2, a writing utensil 1 includes a shaft tube 10, a holder 20 which is inserted into a front opening 11*a* of the shaft tube 10 and protrudes forward from the front end of the shaft tube 10, a writing core 30 which protrudes forward from the front end of the holder 20 while a pencil lead 31 is inserted into the holder 20, a back-and-forth member 40 which contacts the rear side of a writing core support portion 32*g*20 of the writing core 30 and is movable forward and backward by a predetermined amount with respect to the shaft tube 10, and a writing core urge member 50 that urges the back-and-forth member 40 forward with respect to the shaft tube 10.

In the embodiment, the writing core 30 includes a plurality of members with the pencil lead 31, and the pencil lead 31 is not illustrated alone in the drawings.

According to the example illustrated in the drawings, the shaft tube 10 is obtained by connecting and fixing a rear shaft tube 12 to a rear end of a front shaft tube 11 through a connection means such as threading, fitting, and bonding, and is formed in a substantially elongated cylindrical shape of which a front end side is tapered.

As another example of the shaft tube 10, the shaft tube may be formed in a single cylindrical shape, a structure in which a separate opening is connected to a front end of a cylinder, or a structure which is formed by three or more cylinders.

A front opening 11*a* through which the holder 20 to be described later protrudes forward is provided at the front end of the shaft tube 10. The inner peripheral surface of the shaft tube 10 is reduced in diameter in relation to the rear portion of the front opening 11*a*, and a front end of a holder urge member 13 is received by a rear end surface at the inside of the decreased diameter portion.

According to the example illustrated in the drawings, the front opening 11*a* is an inner peripheral surface of a cylindrical hole substantially parallel to the shaft tube axis, and the front edge portion thereof is provided with a convex portion 11*b* which reduces a friction resistance with respect to a cam slant face 20*a* of the holder 20.

Further, an annular step portion 11*c* of which a front side is decreased in diameter is provided at the rear side (specifically, the rear side of a spring receiving portion 21) of the holder 20 in the inner peripheral surface of the shaft tube 10. The step portion 11*c* regulates the forward movement of the entire writing core 30 while receiving a protrusion 32*g*21 of the writing core 30 to be described later from the front side thereof.

Further, an annular step portion 11*n* of which a front side is decreased in diameter is provided at the rear side of the step portion 11*c* in the inner peripheral surface of the shaft tube 10. The step portion 11*n* regulates the forward movement of the back-and-forth member 40 while contacting the front end of the back-and-forth member 40 to be described later from the front side thereof.

Further, the peripheral wall of the shaft tube 10 is provided with a concave portion 12*a* which is recessed in the shaft tube outward radial direction and extends in the shaft tube axial direction, and the back-and-forth member 40 engages with the concave portion 12*a* so as to move forward and backward by a predetermined amount.

Figure 7:
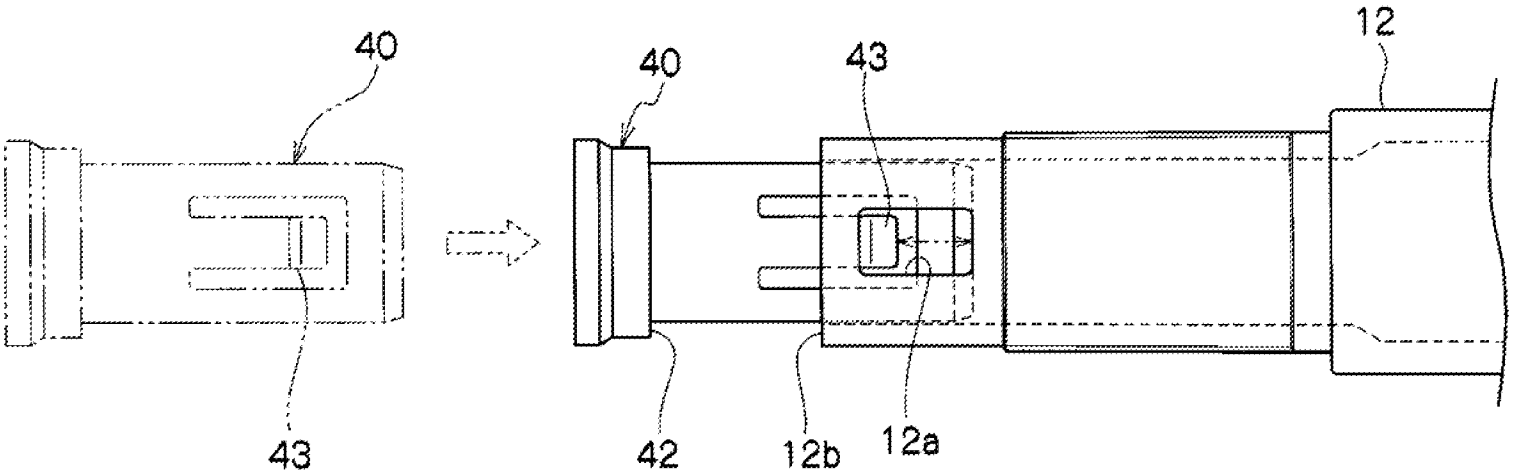
FIG. 7 is a top view illustrating an engagement relation between a back-and-forth member and a shaft tube.

As illustrated in FIG. 7, the concave portion 12*a* is provided with a hole which has a rectangular shape in the top view and pierces the peripheral wall at the front end side of the peripheral wall of the rear shaft tube 12, and the front end of the rear shaft tube 12 including the hole is inserted into the front shaft tube 11. The length of the concave portion 12*a* in the shaft tube axial direction is appropriately set so that the back-and-forth member 40 is movable forward and backward by a predetermined amount.

According to the example illustrated in the drawings, the holder urge member 13 is a compression coil spring having the holder 20 loosely inserted into the center portion thereof, and urges the holder 20 backward through the spring receiving portion 21.

In addition, as another example of the holder urge member 13, the holder urge member may be formed in a structure which is formed of an elastic body such as elastomer resin or rubber, a structure which is formed of an elastic body such as a plate spring, or a structure which is formed by a tensile spring pulling the holder urge member 13 from the rear side thereof.

The holder 20 engages with the front opening 11*a* (specifically, the convex portion 11*b*) through the cam slant face 20*a* of the outer periphery of the holder 20 so as to be movable forward and backward between a forward movement position relative to the shaft tube 10 and the writing core 30 and an initial position before the forward movement.

Figure 8B:
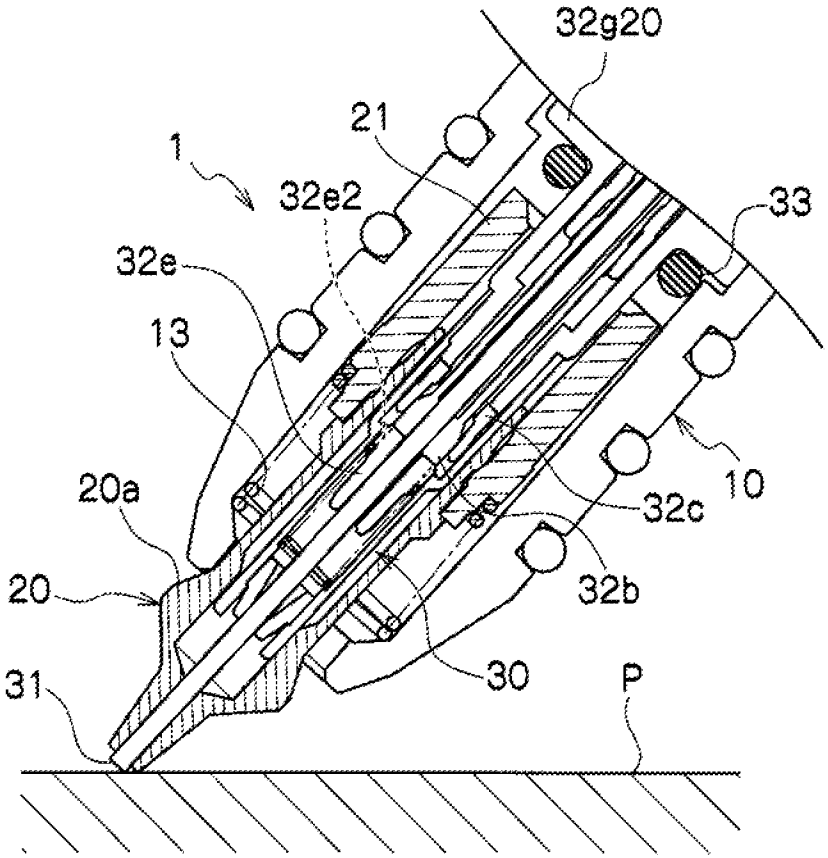
FIGS. 8(*a*) and 8(*b*) are enlarged cross-sectional views of the front end side of the writing utensil, where FIG. 8(*a*) illustrates a normal writing state and FIG. 8(*b*) illustrates a state where the holder moves forward. In the drawings, only the portion moved from the state of FIG. 8(*a*) is indicated by the hatching in FIG. 8(*b*).
Figure 8A:
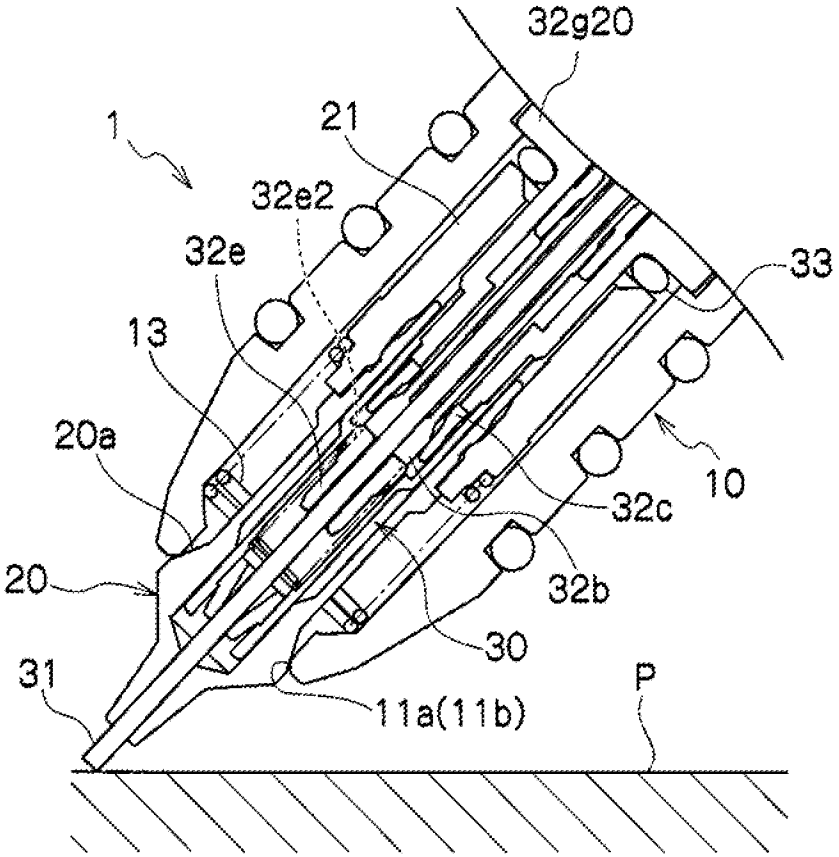

Then, the holder 20 is fitted to the front opening 11*a* so as not to be movable in the shaft tube radial direction in a manner such that the annular cam slant face 20*a* is brought into contact with the entire circumference of the front opening 11*a* of the shaft tube 10 at the initial position (see FIG. 8(*a*)). Further, the holder 20 is fitted to the front opening 11*a* so as to be movable in the shaft tube radial direction at the forward movement position (see FIG. 8(*b*)) since the outer diameter of the rear portion in relation to the cam slant face 20*a* is smaller than the inner diameter of the front opening 11*a*.

Further, the spring receiving portion 21 to be described later is integrally fixed to the rear end of the holder 20. The holder 20 and the spring receiving portion 21 are urged backward relative to the shaft tube by the holder urge member 13 inside the shaft tube 10, and are received by a buffer material 33 formed of an elastic material when moving backward from the forward movement position.

Specifically, the holder 20 is a substantially cylindrical member that pierces the front opening 11*a* in the front and rear direction, and the outer periphery thereof is provided with the annular cam slant face 20*a* which comes into slide contact with the front edge (specifically, the convex portion 11*b*) of the front opening 11*a*.

The cam slant face 20*a* is formed in a conical face shape which is increased in diameter forward and is disposed so as to come into slide contact with the front opening 11*a* (specifically, the convex portion 11*b*). Then, the cam slant face constitutes a movement direction conversion mechanism which moves the holder 20 forward relative to the shaft tube 10 and the writing core 30 due to a force applied to the holder 20 in the shaft tube outward radial direction.

Then, a front portion in relation to the cam slant face 20*a* in the holder 20 is decreased in diameter according to the example illustrated in the drawings.

Further, the holder 20 includes therein a pencil lead slide hole 20*b* which comes into slide contact with the outer peripheral surface of the pencil lead 31 at the front side of the cam slant face 20*a* and a writing core sliding hole 20*c* which comes into slide contact with the writing core 30 while being increased in diameter at the rear side of the pencil lead slide hole 20*b*.

The pencil lead slide hole 20*b* is a hole which has an outer diameter slightly larger than the outer diameter of the pencil lead 31 so as to contact or approach the outer peripheral surface of the pencil lead 31, and extends backward from the front end of the holder 20 so as to communicate with the inside of the writing core sliding hole 20*c*.

The writing core sliding hole 20*c* is a hole which has an inner diameter slightly larger than the outer diameter of a front holding portion 32*g*1 of the front end of the writing core 30 so as to contact or approach the outer peripheral surface of the front end of the writing core 30.

In addition, the writing core sliding hole 20*c* illustrated in the drawings is formed in a step shape which is decreased in diameter forward along the shape of the outer peripheral surface of the front holding portion 32*g*1. However, as another example of the writing core sliding hole 20*c*, the writing core sliding hole may be formed in a cylindrical shape without a step portion as long as the writing core sliding hole moves forward and backward with respect to the front end of the writing core 30 while coming into slide contact with the front end of the writing core 30.

The holder 20 with the above-described structure engages with the front opening 11*a* of the shaft tube 10 so as to be movable forward and backward through the cam slant face 20*a* of the outer periphery, and is inserted into the shaft tube 10. Then, the spring receiving portion 21 is connected and fixed to the outer peripheral surface of the rear end of the holder 20 inside the shaft tube 10 by a connection means such as fitting.

The spring receiving portion 21 is a cylindrical member that has an outer diameter larger than the outer diameter of the rear end of the holder 20 and has a gap with respect to the inner peripheral surface of the shaft tube 10. Here, the annular step portion of the front end thereof is brought into contact with the rear end of the holder urge member 13 so as to be urged backward by the holder urge member 13 and to be received by the buffer material 33 from the rear side.

Figure 9:
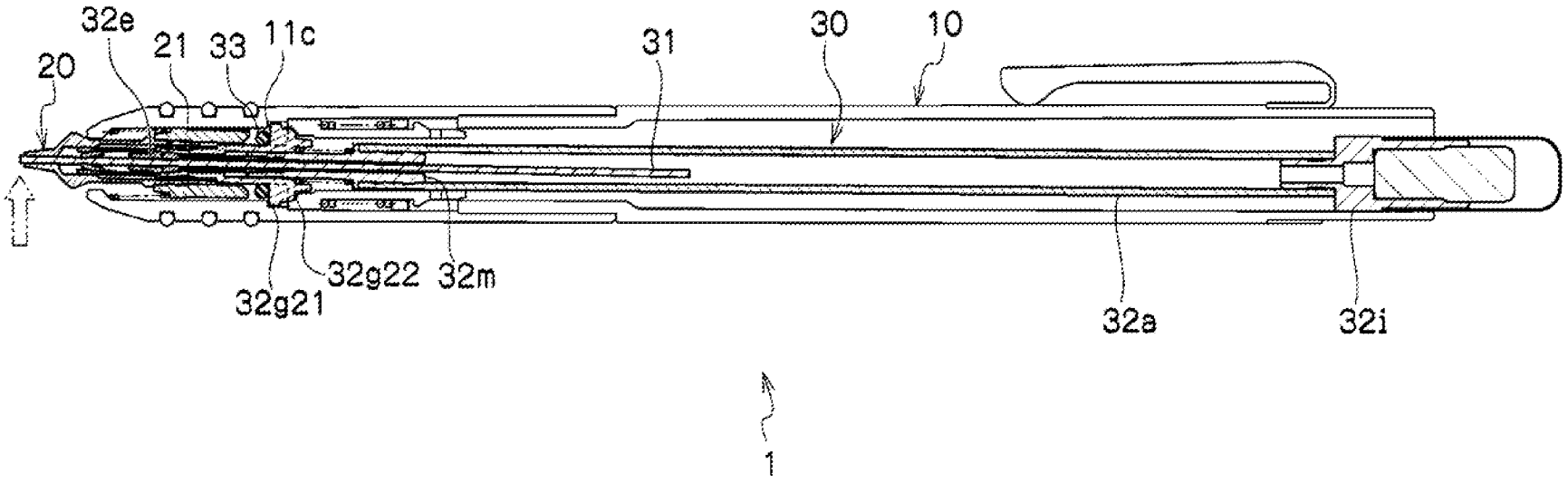
FIG. 9 is an entire cross-sectional view illustrating a state where the holder moves forward with respect to the writing utensil.

The spring receiving portion 21 may be slightly tilted with respect to the shaft tube axis due to the gap (see FIG. 9).

Figure 5:
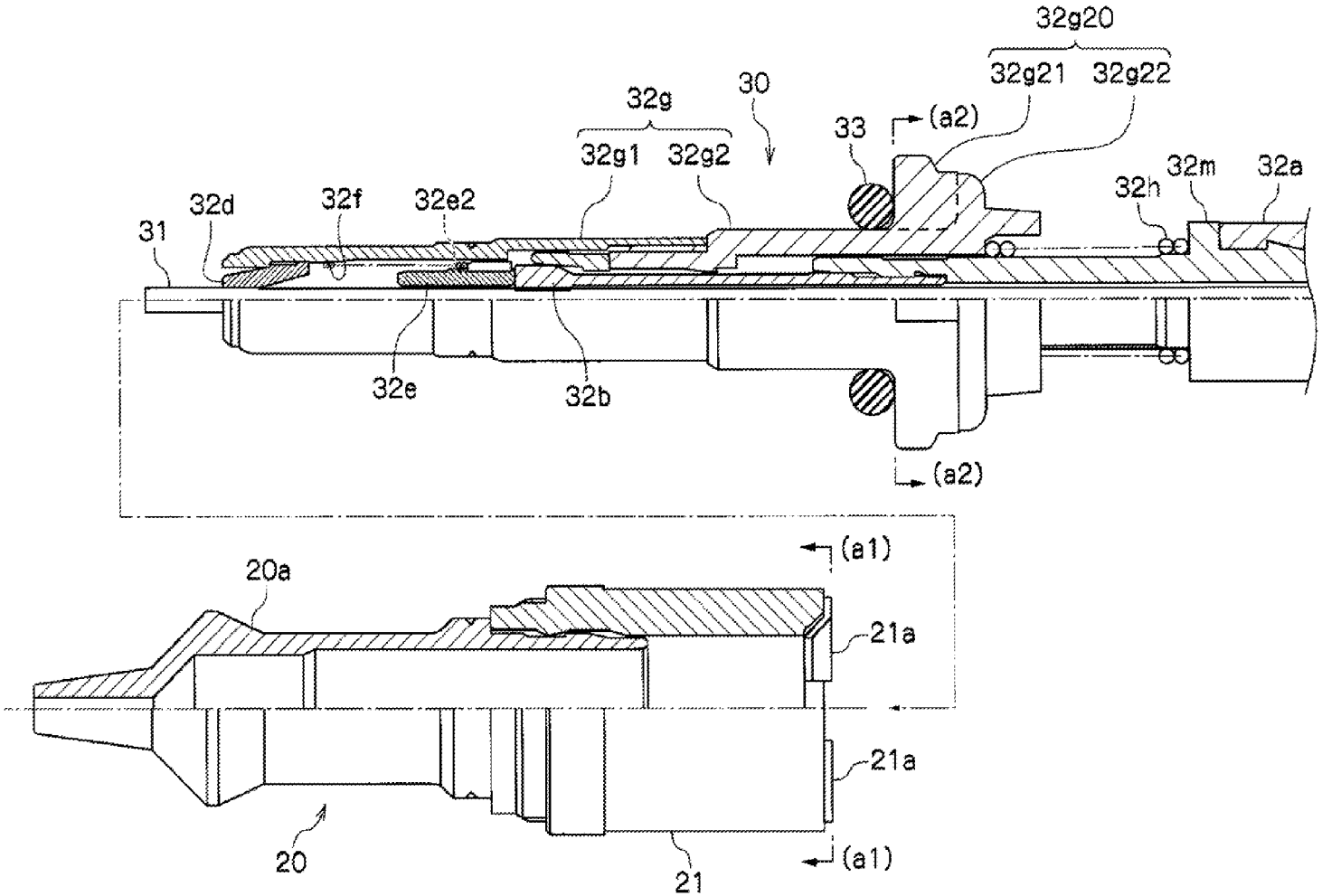
FIG. 5 is a half cross-sectional view illustrating a state where a writing core is separated from a holder.
Figure 6:
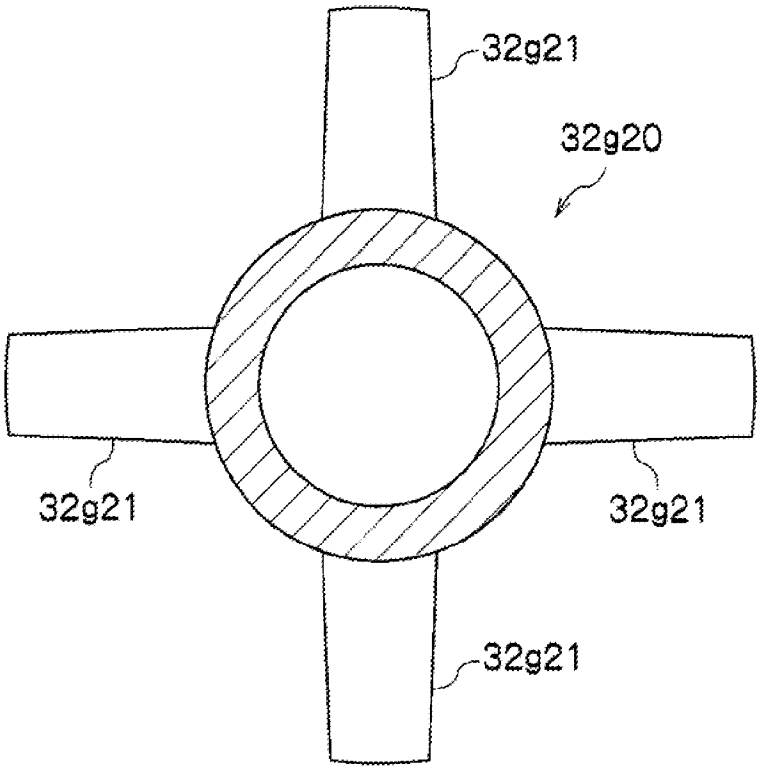
FIG. 6(*a*1) is a cross-sectional view taken along the line (a1)-(a1) of FIG. 5 and FIG. 6(*a*2) is a cross-sectional view taken along the line (a2)-(a2) of FIG. 5.
Figure 6:
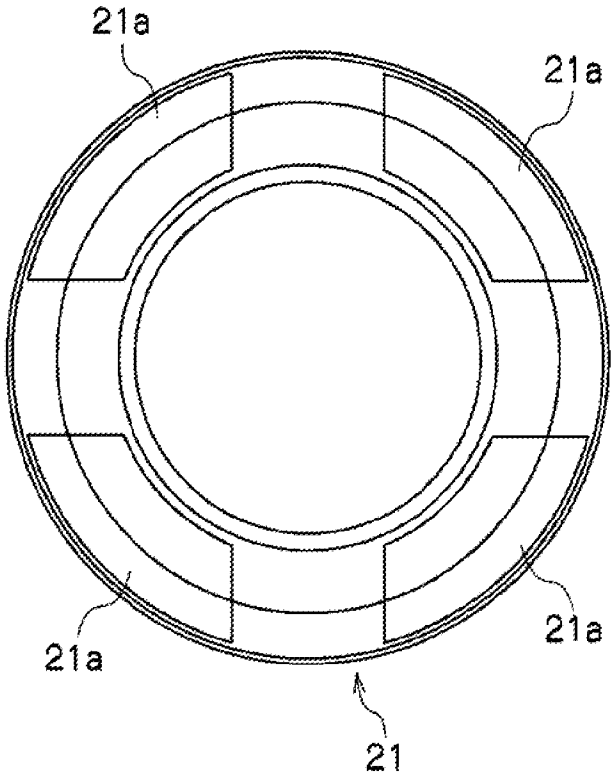

The rear end of the spring receiving portion 21 is provided with a plurality of protrusions 21*a* provided at the same interval in the circumferential direction so as to protrude backward relative to the shaft tube and to partially press the buffer material (see FIGS. 5 and 6(*a*1)).

Further, the buffer material 33 is an annular member that is formed of an elastic material such as rubber or elastomer resin, is fitted in an annular shape to the outer periphery of a holding cylinder 32*g* to be described later, and is elastically deformed while being clipped between the rear end surface of the spring receiving portion 21 and the front end surface of the writing core support portion 32*g*20.

In addition, an O-ring formed of the above-described material is used as the buffer material 33 illustrated in the drawings as a desirable example. However, as another example, a sponge-like synthetic resin foam or the like may be used.

Further, as another example of the buffer material 33, a coil spring having a weak repulsive force compared to the holder urge member 13 may be used.

Further, the writing core 30 is a mechanical pencil writing core which includes the pencil lead 31 and the pencil lead delivering mechanism 32 holding the pencil lead 31 in a delivery manner, and is disposed inside the shaft tube 10 so as to insert the delivered pencil lead 31 into the holder 20.

The pencil lead 31 is a general elongated columnar pencil lead for a mechanical pencil.

The pencil lead delivering mechanism 32 includes a core tank 32*a* which stores the pencil lead 31 therein and is held inside the shaft tube 10 so as to move forward and backward by a predetermined amount, a chuck 32*b* which is connected to the front end of the core tank 32*a* and is opened while moving the clipped pencil lead 31 forward, a clutch ring 32*c* which is fitted to the chuck 32*b* so as to come off from the rear side thereof, a core breaker 32*d* which loosely holds the pencil lead at the front side of the chuck 32*b*, a sliding cylinder 32*e* which is located between the chuck 32*b* and the core breaker 32*d* and is movable forward and backward while inserting the pencil lead 31 therethrough, a sliding cylinder urge member 32*f* that urges the sliding cylinder 32*e* backward, a holding cylinder 32*g* which encloses the chuck 32*b*, the clutch ring 32*c*, the core breaker 32*d*, the sliding cylinder 32*e*, the sliding cylinder urge member 32*f*, and the like therein, and a core tank urge member 32*h* that urges the core tank 32*a* backward with respect to the holding cylinder 32*g*.

The core tank 32*a* is formed in an elongated cylindrical shape capable of storing a plurality of pencil leads 31, and the rear end thereof is disposed near the rear end opening of the shaft tube 10. The core tank 32*a* is obtained by molding a synthetic resin material so that the core tank is elastically bendable.

A pencil lead introduction pipe 32*i* which leads the pencil lead 31 from the rear side of the shaft tube 10 into the core tank 32*a* is connected to the rear end of the core tank 32*a*. Then, an eraser 32*j* which blocks the rear end opening of the pencil lead introduction pipe 32*i* and a knock cap 32*k* which covers the rear side of the eraser 32*j* are separably attached to the rear portion of the pencil lead introduction pipe 32*i*. The rear end of the knock cap 32*k* protrudes backward from the rear end of the shaft tube 10 so as to enable the knock operation.

Further, a connection member 32*m* is integrally connected to the front end of the core tank 32*a*.

The connection member 32*m* is a substantially cylindrical member that is fixed to the front end of the core tank 32*a* and is used to insert the pencil lead 31 therethrough. Here, the rear end of the chuck 32*b* is fixed to the front end of the connection member and the rear end of the core tank urge member 32*h* is received by the flange portion at the center portion thereof in the front and back direction.

In addition, as another example, a structure may be employed in which the connection member 32*m* is not provided, the rear end of the chuck 32*b* is directly connected to the front end of the core tank 32*a*, and the rear end of the core tank urge member 32*h* is directly received by the front edge of the core tank 32*a*.

The chuck 32*b* is formed of a metal material or a synthetic resin material which is elastically bendable, and includes a plurality of (for example, about two to four) claw portions disposed in a concentric shape so as to be located around the pencil lead 31. Then, the claw portions are bent in the shaft tube inward radial direction while clipping the pencil lead 31 so that the pencil lead is not movable backward, and the claw portions are elastically restored so that the pencil lead 31 is released.

The front end of the chuck 32*b* including the claw portions is inserted into the holding cylinder 32*g*. The front end including the claw portions is formed so that the outer diameter portion is larger than that of the rear portion.

The clutch ring 32*c* is a substantially cylindrical member, and engages with the inner peripheral surface of the holding cylinder 32*g* to be described later so that the clutch ring moves forward and backward by a predetermined amount.

The clutch ring 32*c* is fitted to the plurality of claw portions of the chuck 32*b* from the rear side thereof so as to keep the plurality of claw portions in a closed state, and is locked to the holding cylinder 32*g* when moving along with the chuck 32*b* so as to come off from the plurality of claw portions backward.

In addition, the chuck 32*b* and the clutch ring 32*c* may have known structures.

The core breaker 32*d* is a cylindrical member that is formed of an elastic body such as synthetic rubber or elastomer resin, and is immovably fitted into the front end of the holding cylinder 32*g* so as to elastically grip the pencil lead 31 inserted thereinto.

The sliding cylinder 32*e* is a substantially cylindrical member that receives the rear end of the sliding cylinder urge member 32*f* by the step portion of the outer peripheral surface thereof and loosely inserts the pencil lead 31 into the center portion thereof, and is urged backward by the sliding cylinder urge member 32*f* so as to come into contact with the front end of the chuck 32*b*. The inner peripheral surface of the sliding cylinder 32*e* has a cylindrical shape which is continuous in the entire circumference, and has an inner diameter near or contacting the outer peripheral surface of the pencil lead 31.

Further, the rear end of the sliding cylinder 32*e* is increased in diameter compared to the front side thereof, and an enlarged portion 32*e*1 is provided with a core powder escape groove 32*e*2 through which the core powder escapes.

Figure 4:
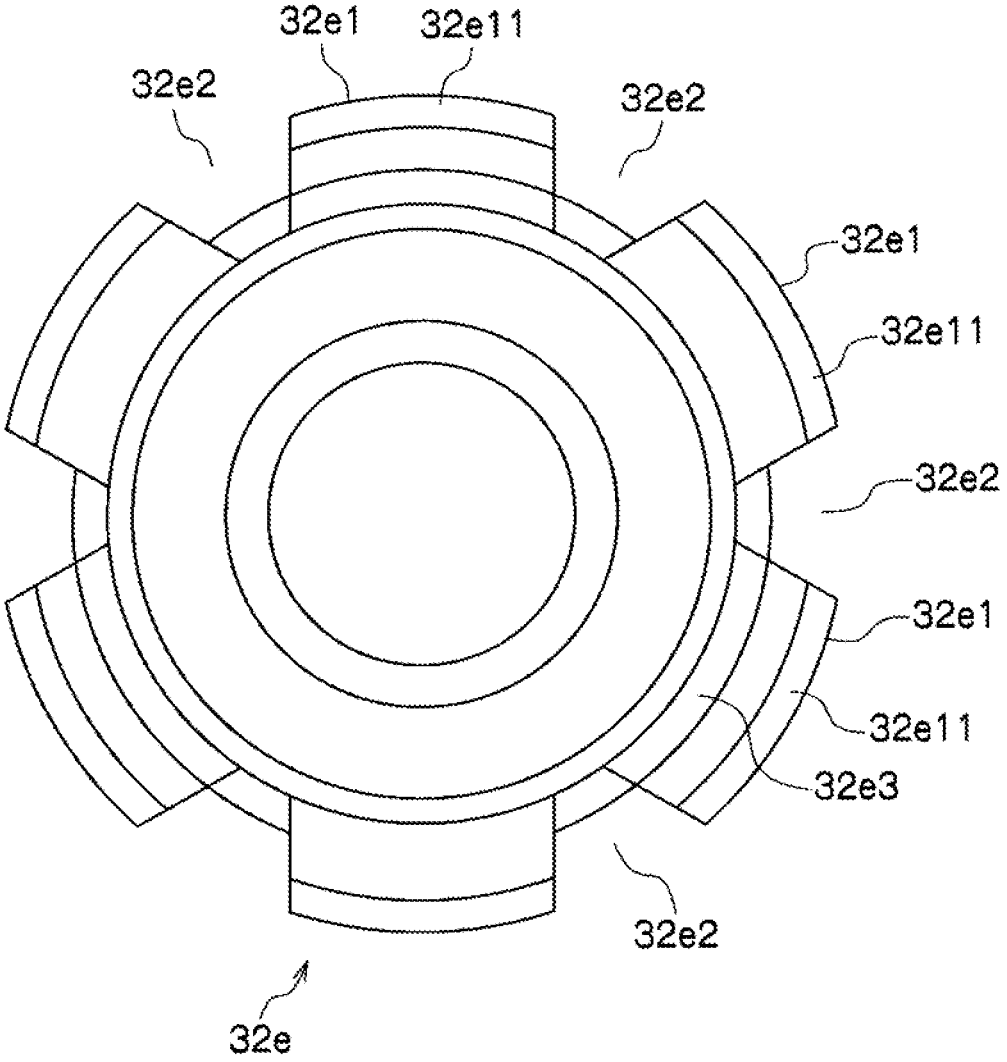
FIG. 4 is a front view of the sliding cylinder.

The core powder escape groove 32*e*2 is continuous in the axial direction so as to pierce the peripheral wall of the enlarged portion 32*e*1 in the axial direction, and is provided at a plurality of positions at the same interval in the circumferential direction of the sliding cylinder 32*e* as illustrated in FIG. 4. The width and the depth of the sliding cylinder 32*e* are appropriately set so as to move the core powder in the axial direction.

A portion between the core powder escape grooves 32*e*2 which are adjacent to each other in the circumferential direction is formed in a longitudinal rib shape, and the front end of the longitudinal rib-shaped portion is provided with a chamfered portion 32*e*11 which is inclined in the forward oblique axis direction. The friction resistance generated between the chamfered portion 32*e*11 and the inner peripheral surface of the holding cylinder 32*g* when the sliding cylinder 32*e* moves forward and backward decreases. Further, the front end surface of the enlarged portion 32*e*1 serves as a receiving portion which receives the rear end seat portion of the sliding cylinder urge member 32*f*.

Figure 3:
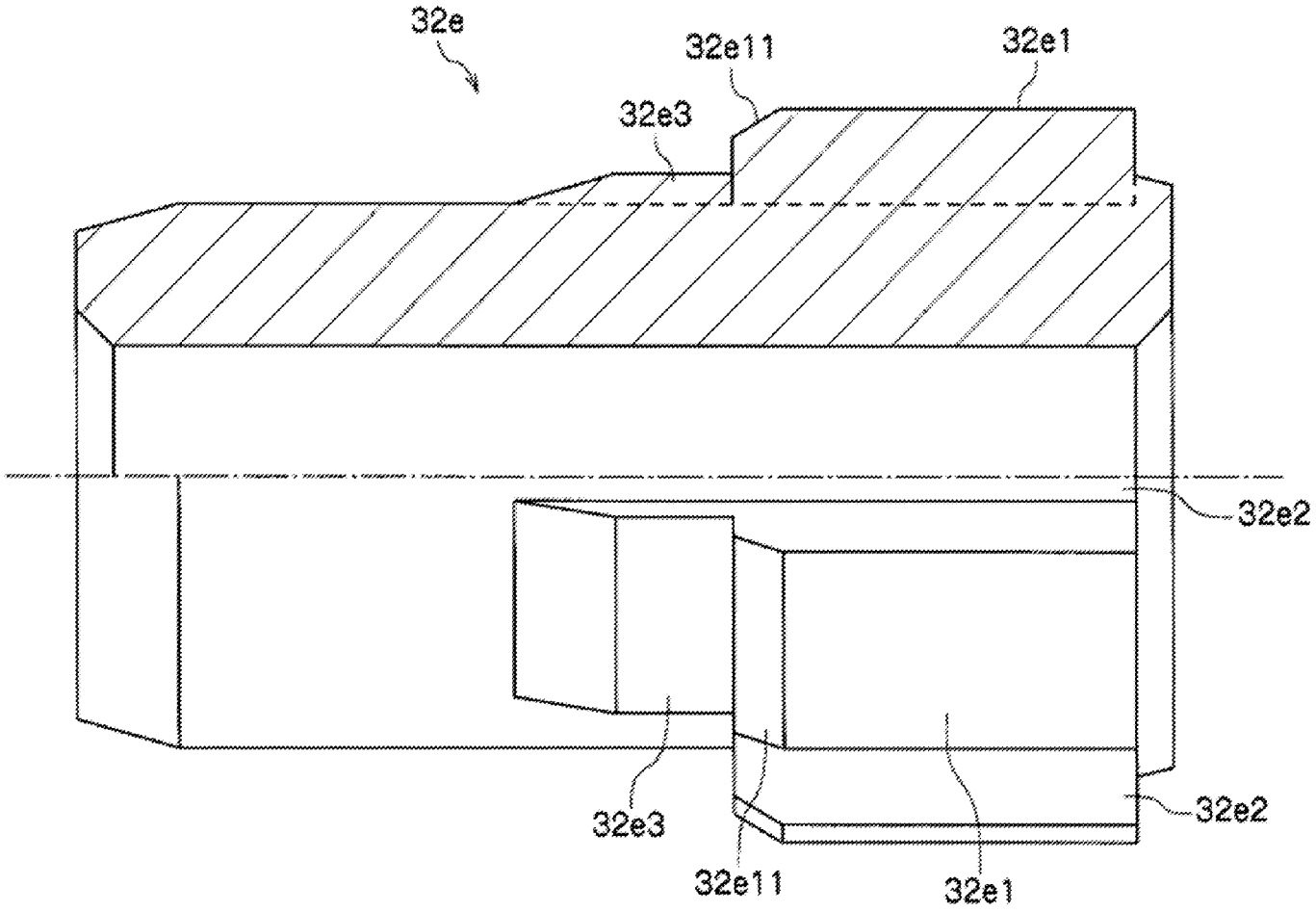
FIG. 3 is a half cross-sectional view illustrating an example of a sliding cylinder.

Further, the reference numeral 32*e*3 of FIG. 3 indicates a rib which is fitted to the inner peripheral surface of the rear end of the sliding cylinder urge member 32*f*.

The sliding cylinder urge member 32*f* is a compressing coil spring which is located in an annular shape around the pencil lead 31. Here, the front end thereof is locked into the holding cylinder 32*g* and the rear end thereof comes into contact with the sliding cylinder 32*e*.

As another example of the sliding cylinder urge member 32*f*, an elastic body which is formed of elastomer resin or rubber or a tensile spring which pulls the sliding cylinder 32*e* backward may be used.

The holding cylinder 32*g* includes a front holding portion 32*g*1 which is inserted into the holder 20 so as to be movable forward and backward and a rear holding portion 32*g*2 which is integrally connected to the rear end of the front holding portion 32*g*1.

In addition, in the embodiment, the holding cylinder 32*g* includes a plurality of members as in the above-described example so as to have particularly satisfactory productivity, but the holding cylinder may be a single member as another example.

The front holding portion 32*g*1 is formed in a substantially cylindrical shape having a step portion of which the front side thereof is decreased in diameter, and is inserted into the writing core sliding hole 20*c* of the holder 20 while the outer peripheral surfaces of the front and rear ends thereof come into slide contact with the inner surface of the holder 20.

The front end of the chuck 32*b*, the clutch ring 32*c*, the core breaker 32*d*, the sliding cylinder 32*e*, and the sliding cylinder urge member 32*f* are inserted into the front holding portion 32*g*1.

The inner peripheral surface of the front holding portion 32*g*1 is provided with a rear contact portion 32*g*11 which receives the clutch ring 32*c* from the rear side thereof and a front contact portion 32*g*12 which receives the clutch ring 32*c* from the front side thereof when the clutch ring moves forward. According to the example illustrated in the drawings, the rear contact portion 32*g*11 is the front end of the rear holding portion 32*g*2. Further, the front contact portion 32*g*12 is a step portion which is formed by decreasing the diameter of the front portion of the front holding portion 32*g*1.

Inside the rear holding portion 32*g*2, the base end of the chuck 32*b* is fixed to the front end thereof and the front end of the connection member 32*m* is inserted into the rear side thereof so as to be movable forward and backward.

Further, the front end of the rear holding portion 32*g*2 is connected and fixed to the front holding portion 32*g*1, and the rear end of the rear holding portion 32*g*2 receives the front end of the core tank urge member 32*h*.

Further, the writing core support portion 32*g*20 which protrudes in the outward radial direction is integrally connected to the outer periphery of the rear portion of the rear holding portion 32*g*2 and the buffer material 33 is fitted in an annular shape to the front side of the writing core support portion 32*g*20.

The writing core support portion 32*g*20 is finely movable backward and in the shaft tube radial direction while contacting the step portion 11*c* and a writing core support slant face 41 inside the shaft tube 10.

Specifically, the writing core support portion 32*g*20 includes a protrusion 32*g*21 which may come into contact with the step portion 11*c* inside the shaft tube 10 from the rear side thereof and a contact portion 32*g*22 which may come into contact with the writing core support slant face 41 of the back-and-forth member 40 at the rear side of the protrusion 32*g*21.

The protrusion 32*g*21 engages with the shaft tube 10 so that the writing core 30 is not movable forward with respect to the shaft tube 10 and is movable in the shaft tube radial direction by the tilting operation with the forward movement of the holder 20.

Specifically, as illustrated in FIGS. 2 and 6(*a*2), a plurality of (four in the example illustrated in the drawings) protrusions 32*g*21 is provided at an interval in the shaft tube circumferential direction of the outer periphery of the rear holding portion 32*g*2. Each protrusion 32*g*21 protrudes in the shaft tube outward radial direction. A gap which enables the movement of the writing core 30 in the shaft tube radial direction is ensured between the inner peripheral surface of the shaft tube 10 and each protrusion 32*g*21. That is, the outer diameter of the plurality of protrusions 32*g*21 is set to be smaller than the inner diameter of the shaft tube 10.

Further, the contact portion 32*g*22 is integrally formed with the protrusion 32*g*21 at the rear side of the protrusion 32*g*21, and is formed in a convex shape coming into slide contact with the writing core support slant face 41 of the front end of the back-and-forth member 40 to be described later.

Thus, according to the above-described structure, as illustrated in FIG. 9, the front portion of the entire writing core 30 is rotatable toward one side in the shaft tube radial direction by using the protrusion 32*g*21 and the contact portion 32*g*22 as support points, and the rear portions of the support points rotate toward the opposite side in the shaft tube radial direction during the rotation thereof.

Further, according to the writing core support portion 32*g*20 with the above-described structure, each protrusion 32*g*21 locally presses the buffer material 33, and hence it is possible to comparatively increase the elastic deformation amount of the buffer material 33 at the pressed portion.

Further, the back-and-forth member 40 is a substantially cylindrical member that loosely inserts the writing utensil 1 into the center portion thereof. The writing core support slant face 41 which is increased in diameter forward in a substantially conical face shape is formed near the inner diameter of the front end surface of the back-and-forth member 40.

The writing core support slant face 41 comes into slide contact with the contact portion 32*g*22 of the pencil lead delivering mechanism 32 so that the holder 20 and the pencil lead delivering mechanism 32 are easily tilted.

Further, the outer peripheral surface of the back-and-forth member 40 is provided with a step portion 42 which receives the front end of the writing core urge member 50, and an engagement protrusion 43 which engages with the concave portion 12*a* of the shaft tube 10 so as to be movable forward and backward is provided at the rear side of the step portion 42. The step portion 42 is an annular step portion of which the front side is increased in diameter.

The engagement protrusion 43 is provided at a plurality of (two in the example illustrated in the drawings) positions so as to correspond to each concave portion 12*a* of the shaft tube 10. As illustrated in FIG. 7, each engagement protrusion 43 is provided at the inner portion of the U-shaped notch formed in the peripheral wall of the back-and-forth member 40. According to this structure, the engagement protrusion 43 may be easily bent elastically in the shaft tube radial direction. Thus, it is possible to easily perform an operation of locking the engagement protrusion 43 into the concave portion 12*a* while the back-and-forth member 40 is inserted into the rear shaft tube 12 as illustrated in FIG. 7.

Each engagement protrusion 43 is movable forward and backward inside the concave portion 12*a* and is held near the front end inside the concave portion 12*a* due to the urging force of the writing core urge member 50 in a normal state.

The writing core urge member 50 is attached to the outer periphery of the back-and-forth member 40 in an annular shape, and urges the back-and-forth member 40 forward while the front end thereof comes into contact with the step portion 42 of the outer periphery of the back-and-forth member 40 and the rear end thereof comes into contact with the step portion 12*b* as the front end of the rear shaft tube 12.

The repulsive force of the writing core urge member 50 is appropriately set so that the writing core 30 moves backward by a force of a predetermined writing pressure or more.

In addition, the writing utensil 1 is provided with the above-described four urge members, but the urging force of the urge member becomes smaller in order of the sliding cylinder urge member 32*f*, the holder urge member 13, the writing core urge member 50, and the core tank urge member 32*h*.

Next, a featured operation and effect of the writing utensil 1 with the above-described structure will be described in detail.

First, when a pressing force is applied to the knock cap 32*k* in a case where the pencil lead 31 protrudes, the holding cylinder 32*g* becomes an immovable state while the writing core support portion 32*g*20 comes into contact with the step portion 11*c*. In this state, the chuck 32*b* moves forward while clipping the pencil lead 31 with the forward movement of the core tank 32*a*, and the front end of the pencil lead 31 is elastically clipped by the core breaker 32*d*. Further, the clutch ring 32*c* comes off while being locked to the holding cylinder 32*g* (specifically, the front contact portion 32*g*12) so that the chuck 32*b* is released in the shaft tube outward radial direction.

Then, when the pressing force is removed, the chuck 32*b* moves backward and is narrowed while being fitted to the clutch ring 32*c* so that the pencil lead 31 is clipped again. These operations are repeated by the knock operation, and the pencil lead 31 moves forward so as to protrude from the front end of the holder 20.

Then, when the chuck 32*b* moves forward, the sliding cylinder 32*e* which covers and protects the pencil lead 31 while being pressed by the chuck 32*b* also moves forward against the urging force of the sliding cylinder urge member 32*f*.

Since a portion between the core breaker 32*d* and the sliding cylinder 32*e* of the pencil lead 31 is covered and protected by the sliding cylinder 32*e*, it is possible to prevent a problem in which the pencil lead 31 is bent by the dropping or the like of the writing utensil 1 or the bent pencil lead or the remaining pencil lead is stuck between the core breaker 32*d* and the chuck 32*b*.

Further, when the chuck 32*b* and the sliding cylinder 32*e* repeatedly move forward and backward, core powder may be slightly generated by the slide contact of the chuck 32*b*, the sliding cylinder 32*e*, and the pencil lead 31. However, the core powder escapes forward or backward in the axial direction by the core powder escape groove 32*e*2 of the outer periphery of the sliding cylinder 32*e* while not being accumulated on the outer periphery of the sliding cylinder 32*e*. Thus, it is possible to prevent a problem in which the core powder is fixed to the outer periphery of the sliding cylinder 32*e* so that the forward and backward movement of the sliding cylinder 32*e* or the forward and backward movement of the chuck 32*b* pressing and moving the sliding cylinder 32*e* is disturbed.

In addition, a case is expected in which the core powder is finally discharged toward the front side of the holder 20 along with the pencil lead 31 while passing through the gap of the outer periphery of the pencil lead 31.

Further, in a normal writing state where the shaft tube 10 is tilted and pressed against the writing target surface P, a reaction force (a writing pressure) in a direction (in other words, the shaft tube radial direction) intersecting the pencil lead 31 is applied from the writing target surface P to the pencil lead 31 of the writing core 30 protruding forward from the holder 20 as illustrated in FIG. 8(*a*). At this time, when the reaction force is larger than the normal writing pressure range, the holder 20 receives the reaction force and moves forward against the urging force of the holder urge member 13 while the cam slant face 20*a* of the holder 20 moves in the shaft tube outward radial direction while coming into slide contact with the front opening 11*a* (specifically, the convex portion 11*b*). During the forward movement, the writing core 30 including the pencil lead 31 moves in the shaft tube radial direction so as to be tilted along with the holder 20 and the pencil lead delivering mechanism 32.

Then, the front end of the pencil lead 31 constituting the writing core 30 is covered and protected by the forward moving holder 20 (see FIG. 8(*b*)).

Further, when the pencil lead 31 is separated from the writing target surface P so that the reaction force is removed, the holder 20 moves backward by the urging force of the holder urge member 13 so as to be returned to the initial position.

During the backward movement, the rear end of the spring receiving portion 21 which is integrated with the holder 20 comes into contact with the buffer material 33. Since the buffer material 33 is received by the writing core support portion 32*g*20 from the rear side thereof, the buffer material is elastically contracted. For this reason, it is possible to reduce the impact sound which is generated when the holder 20 comes into contact with the front opening 11*a* of the shaft tube 10.

Further, the spring receiving portion 21 causes the protrusions 21*a* divided in the circumferential direction to come into contact with the buffer material 33 during the backward movement. Further, the writing core support portion 32*g*20 also causes the protrusions 32*g*21 divided in the circumferential direction to come into press contact with the buffer material 33. Thus, the buffer material 33 may be locally contracted in the circumferential direction, and hence the impact sound may be effectively reduced.

In addition, as another example, a protrusion not illustrated in the drawings may be brought into contact with the buffer material 33 or a flat surface may be brought into contact with the buffer material 33 while the protrusion 21*a* or the protrusion 32*g*21 is not provided.

Further, the urging force of the holder urge member 13 is appropriately set so that the holder 20 does not move forward at a normal writing pressure in a direction intersecting the pencil lead 31 and the holder 20 moves forward before the pencil lead 31 is bent by a writing pressure in a direction intersecting the pencil lead 31.

Further, the movement of the entire writing core 30 during the forward movement will be described. As illustrated in FIG. 9, the writing core 30 is formed so that the front portions of the protrusion 32*g*21 and the contact portion 32*g*22 as support points are rotated toward one side (the upside of FIG. 9) in the shaft tube radial direction and the rear portions (the core tank 32*a* and the like) thereof are rotated toward the other side in the shaft tube radial direction.

Then, the core tank 32*a* is elastically bent while the pencil lead introduction pipe 32*i* of the rear end thereof is brought into contact with the inner peripheral surface of the shaft tube. By the rotation of the entire writing core 30, the holder 20 moves forward while smoothly moving in the outward radial direction so as to be tilted.

In addition, a range from the holder 20 to the connection member 32*m* in the shaft tube axial direction is maintained in a substantially straight shape during the above-described rotation. For this reason, the pencil lead 31 is not bent due to the curved range. Further, since a portion which protrudes backward from the connection member 32*m* in the pencil lead 31 is located in a space inside the core tank 32*a* having an inner diameter larger than the connection member 32*m* as illustrated in FIG. 9, the pencil lead 31 is not bent by the contact with respect to the inner peripheral surface of the core tank 32*a*.

Next, an operation in which a pressing force is applied to the pencil lead 31 in the shaft tube axial direction will be described in detail.

Figure 10A:
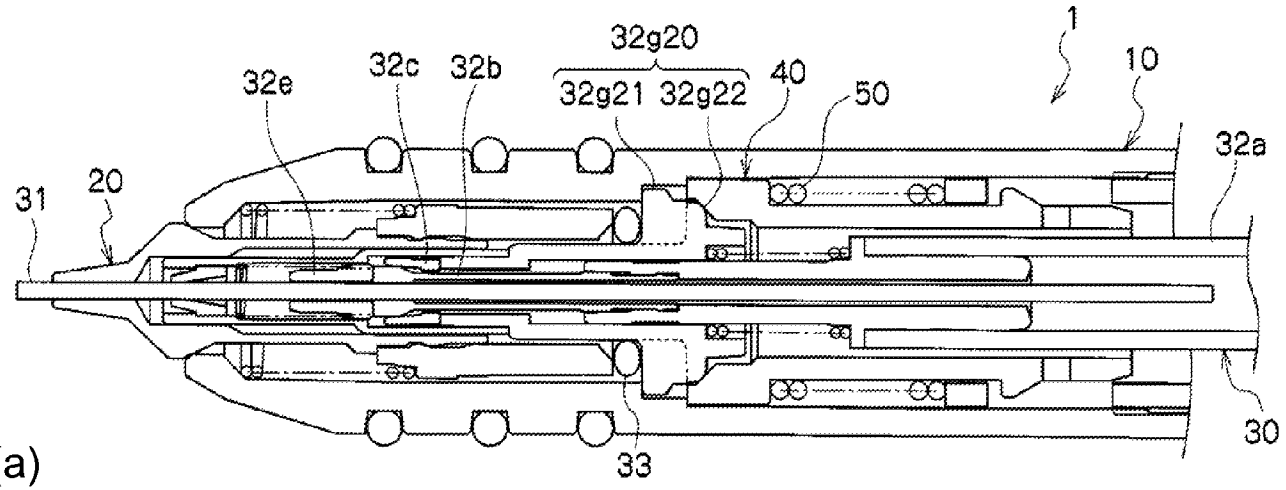
FIGS. 10(*a*) and 10(*b*) are cross-sectional views illustrating a main part of the writing utensil, where FIG. 10(*a*) illustrates a normal state and FIG. 10(*b*) illustrates a state where the writing core is pressed backward. In the drawings, only the portion moved from the state of FIG. 10(*a*) is indicated by the hatching in FIG. 10(*b*).
Figure 10B:
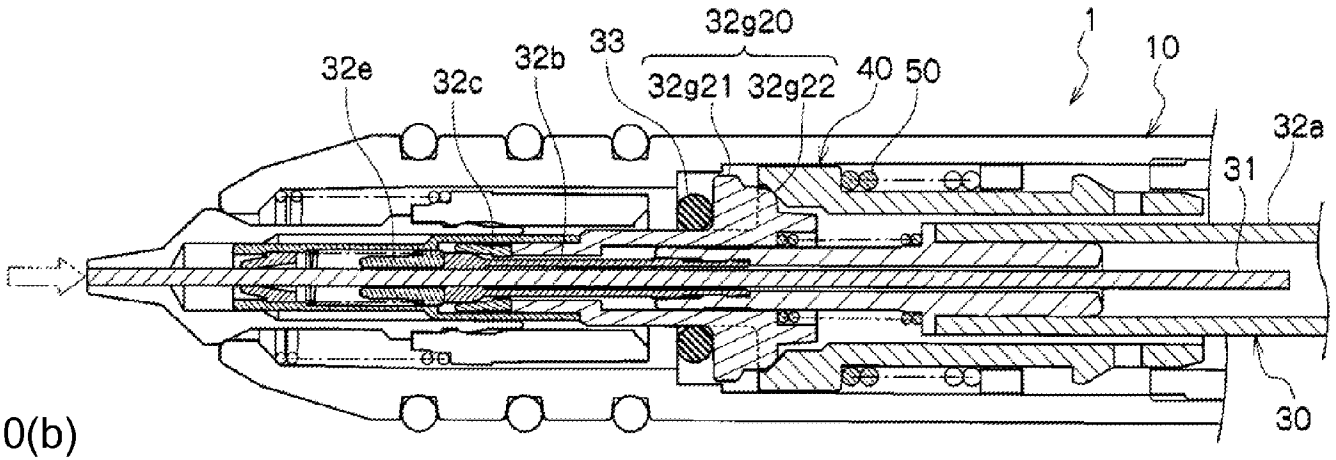

When the protruding pencil lead 31 is strongly pressed against the writing target surface P in a direction perpendicular thereto so that the pencil lead 31 receives a backward pressing force, the pressing force is first applied to the chuck 32*b* which clips the pencil lead 31 so that the pencil lead is not movable backward as illustrated in FIGS. 1, 10(*a*), and 10(*b*). Then, the pressing force applied to the chuck 32*b* is transmitted to the back-and-forth member 40 through the clutch ring 32*c* and the holding cylinder 32*g*, and the back-and-forth member 40 moves backward against the urging force of the writing core urge member 50.

Thus, the pencil lead 31 is retracted into the holder 20 so that the pencil lead is not damaged by the pressing force as illustrated in FIG. 10.

In addition, according to the above-described embodiment, the cam slant face 20*a* of the holder 20 is formed as a slant face having a straight cross-section. However, as another example of the cam slant face, a slant face (see FIG. 11(*a*)) having a convex cross-section, a slant face (see FIG. 11(*b*)) having a concave cross-section, or an intermittent slant face (see FIG. 11(*c*)) may be used.

Next, a modified example of the feature of the writing utensil according to the invention will be described. In addition, since a modified example illustrated below is obtained by modifying a part of the writing utensil 1, a modification part thereof will be mainly described in detail. Then, the same reference numeral of the writing utensil 1 will be given to the modified writing utensil 1, and the repetitive description thereof will not be presented.

Figure 12B:
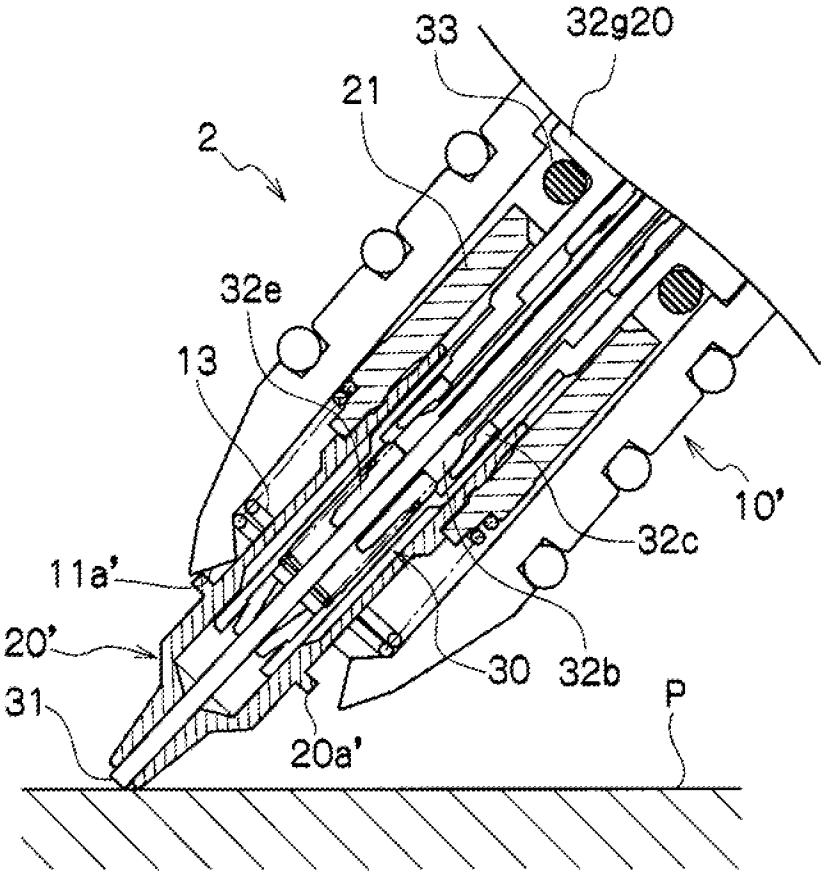
FIGS. 12(*a*) and 12(*b*) are enlarged cross-sectional views illustrating the front end side in another example of the writing utensil according to the invention, where FIG. 12(*a*) illustrates a normal writing state and FIG. 12(*b*) illustrates a state where the holder moves forward. In the drawings, only the portion moved from the state of FIG. 12(*a*) is indicated by the hatching in FIG. 12(*b*).
Figure 12A:
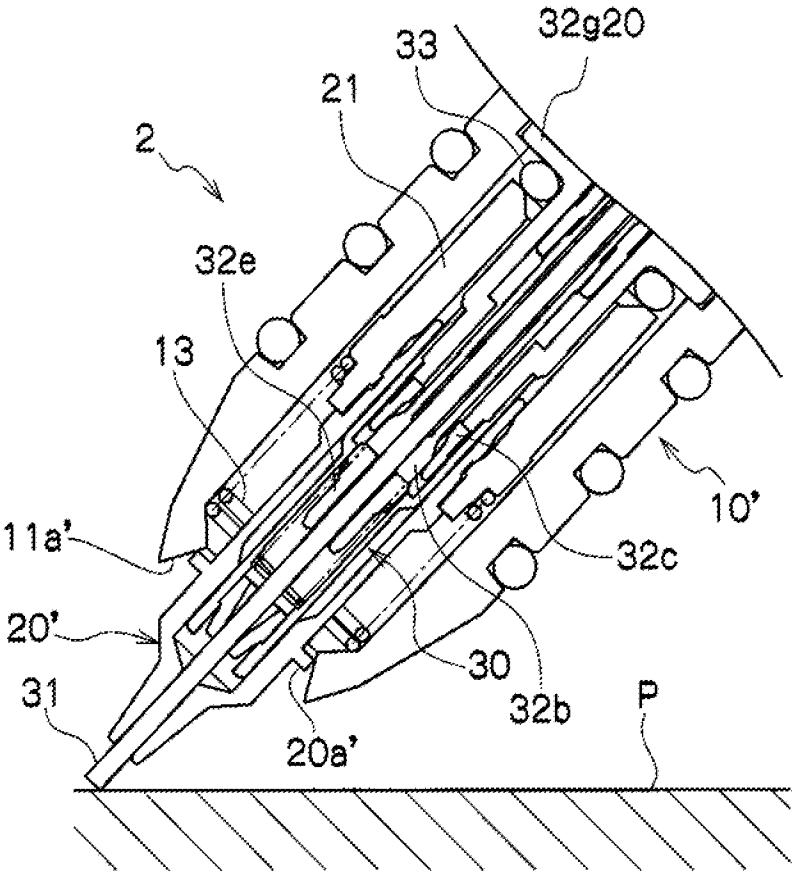

The writing utensil 2 illustrated in FIGS. 12(*a*) and 12(*b*) is provided so that a cam slant face 11*a*' is provided in the front opening of the shaft tube 10'. The cam slant face 11*a*' constitutes a movement direction conversion mechanism which moves a holder 20' forward in a slide contact state by the force applied to the holder 20' in the shaft tube outward radial direction.

The shaft tube 10' includes a single or plural cylinders similarly to the shaft tube 10, and the front end side opening decreased in diameter is provided with an annular cam slant face 11*a*' which is increased in diameter forward.

The holder 20' engages with the front opening of the shaft tube 10' through the cam slant face 11*a*' so as to be movable forward and backward, and is movable in the shaft tube radial direction while being urged toward the rear side of the shaft tube by the holder urge member 13 inside the shaft tube 10' and moving forward against the urging force of the holder urge member 13.

That is, the holder 20' has a structure in which the cam slant face 20*a* of the holder 20 is replaced by the cam slant face 11*a*' of the front opening of the shaft tube 10' and the outer peripheral surface of the holder 20' is provided with an annular protrusion 20*a*'. The annular protrusion 20*a*' is disposed so as to come into slide contact with the cam slant face 11*a*'.

According to the writing utensil 2 illustrated in FIGS. 12(*a*) and 12(*b*), when a reaction force (a writing pressure) is applied in the intersection direction from the writing target surface P to the pencil lead 31 of the writing core 30 protruding forward from the holder 20' similarly to the writing utensil 1 and the reaction force is larger than the normal writing pressure range, the holder 20' receives the reaction force and the annular protrusion 20*a*' of the holder 20' is slid on the cam slant face 11*a*' of the front opening of the shaft tube 10'. Thus, the holder moves forward while moving in the shaft tube outward radial direction.

Thus, even in the writing utensil 2, the pencil lead 31 which protrudes from the holder 20' may be covered and protected by the forward moving holder 20'.

Further, the core powder which is generated by the forward and backward movement of the chuck 32*b* and the sliding cylinder 32*e* escapes in the axial direction by the core powder escape groove 32*e*2 (see FIG. 3) of the outer periphery of the sliding cylinder 32*e*, and hence the operation error caused by the fixing of the core powder may be reduced.

Further, the spring receiving portion 21 which moves backward along with the holder 20' during the backward movement of the holder 20' comes into contact with the buffer material 33 so that the buffer material 33 is elastically contracted. For this reason, it is possible to reduce the operation sound caused by the backward movement of the holder 20' and the spring receiving portion 21.

In addition, according to the above-described embodiment, when the holder 20 (or 20') is tilted so as to move forward while moving in the shaft tube outward radial direction, the core tank 32*a* is bent due to the contact between the shaft tube 10 and the rear end thereof (see FIG. 9). However, as another example, the core tank 32*a* may be connected to the connection member 32*m* in a swinging manner. In another example, for example, a concave portion and a convex portion which are fitted to each other with a play in the shaft tube radial direction may be provided at one side and the other side of the rear end of the connection member 32*m* and the front end of the core tank 32*a*.

Further, according to the above-described embodiment, the writing core 30 is formed as a mechanical pencil writing core (also referred to as a mechanical pencil refill). However, as another example, the writing core 30 may be formed as a ballpoint pen writing core (a ballpoint pen refill), a felt pen writing core, a marker pen writing core, or a correction pen writing core.

For example, when a ballpoint pen writing core having a needle-shaped (in other words, an elongated cylindrical) ballpoint pen tip is used as the writing core 30, the needle-shaped portion of the ballpoint pen tip is inserted through the holder 20, the front end protrudes forward from the front end of the holder 20 (or 20'), and the ballpoint pen writing core may be supported inside the shaft tube 10 so as to be tiltable similarly to the writing core 30.

In addition, when a writing core other than the mechanical pencil writing core is used as the writing core 30, the front end of the writing core may protrude from the front end of the holder 20 (or 20') so that the front end is not retractable thereinto or the front end of the writing core is retracted from the front end of the holder 20 (or 20').

Further, according to the above-described embodiment, the cam slant face is provided at one side of the holder and the opening of the front end of the shaft tube. However, as another example, the cam slant face may be provided at both sides thereof so that the holder moves forward by the slide contact between the cam slant faces.

Further, according to the above-described embodiment, the cam slant face is provided in the outer peripheral surface of the holder 20 or the front opening of the shaft tube 10. However, as another example, the cam slant face may be provided at a rear end of a holder 20" as illustrated in FIG. 13.

Figure 13:
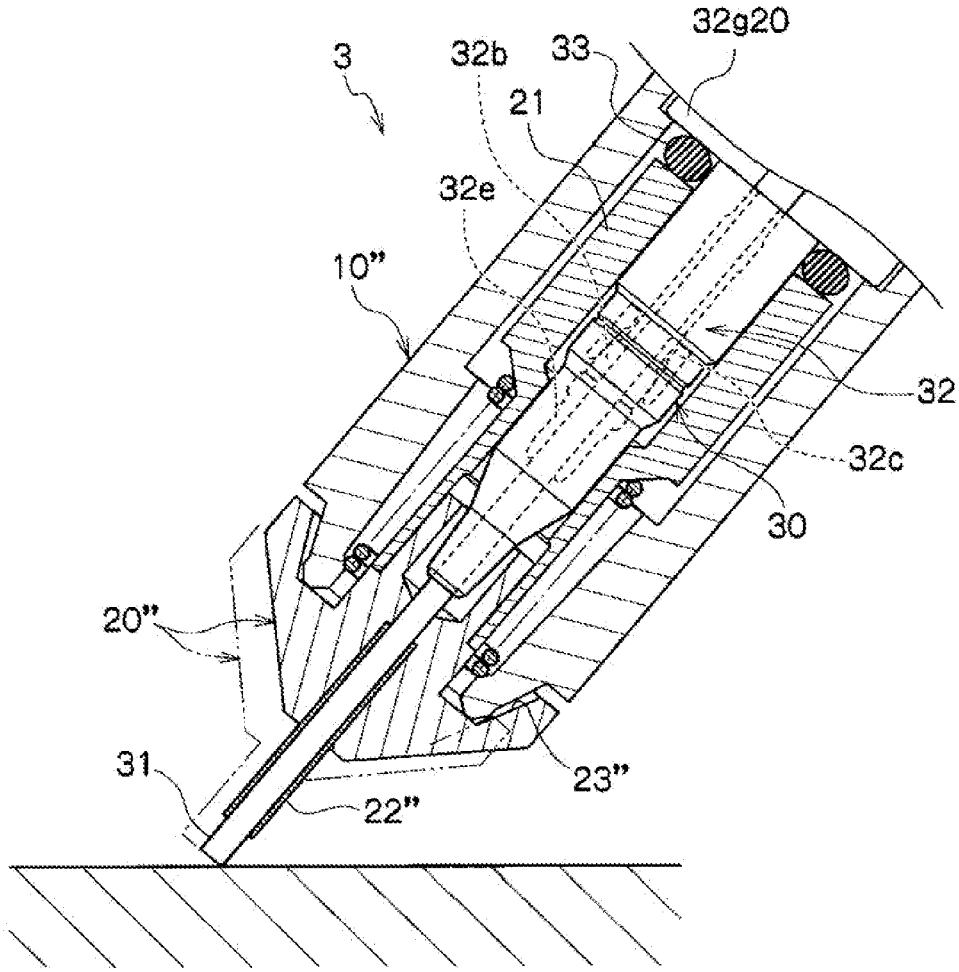
FIG. 13 is a cross-sectional view illustrating a main part of another example of the writing utensil according to the invention.

In a writing utensil 3 illustrated in FIG. 13, the rear end of the holder 20" is provided with an annular concave portion which is loosely fitted to the front edge of a shaft tube 10", and the surface inside the concave portion in the outward radial direction is formed as a cam slant face 23" which is decreased in diameter forward. A pipe-shaped protection pipe 22" is fixed to the front end of the holder 20" so as to cover the pencil lead 31.

According to the writing utensil 3, when a force in the intersection direction is applied to the holder 20" through the pencil lead 31 of the front end of the writing core 30 similarly to the above-described embodiment, the cam slant face 23" slides on the front edge of the shaft tube 10" so that the holder 20" and the protection pipe 22" move forward (see the two-dotted chain line of FIG. 13). That is, the cam slant face 23" serves as a movement direction conversion mechanism which moves the holder 20" forward by the force applied to the cam slant face 23" in the shaft tube outward radial direction.

Thus, the front end of the pencil lead 31 may be covered and protected by the forward moving protection pipe 22".

Further, the core powder escapes in the axial direction through the core powder escape groove **32*e*2 (see FIG. 3) by substantially the same mechanism as the writing utensils 1 and 2. Accordingly, it is possible to reduce an operation error caused by the fixing of the core powder and to reduce the operation sound generated when the holder 20" and the spring receiving portion 21 move backward by the buffer material 33**.

Further, according to the above-described embodiment, the back-and-forth member 40 is interposed between the writing core urge member 50 and the writing core support portion **32*g*20 of the writing core 30. However, the back-and-forth member 40 may not be provided as in a writing utensil 4 illustrated in FIG. 14**.

Figure 14:
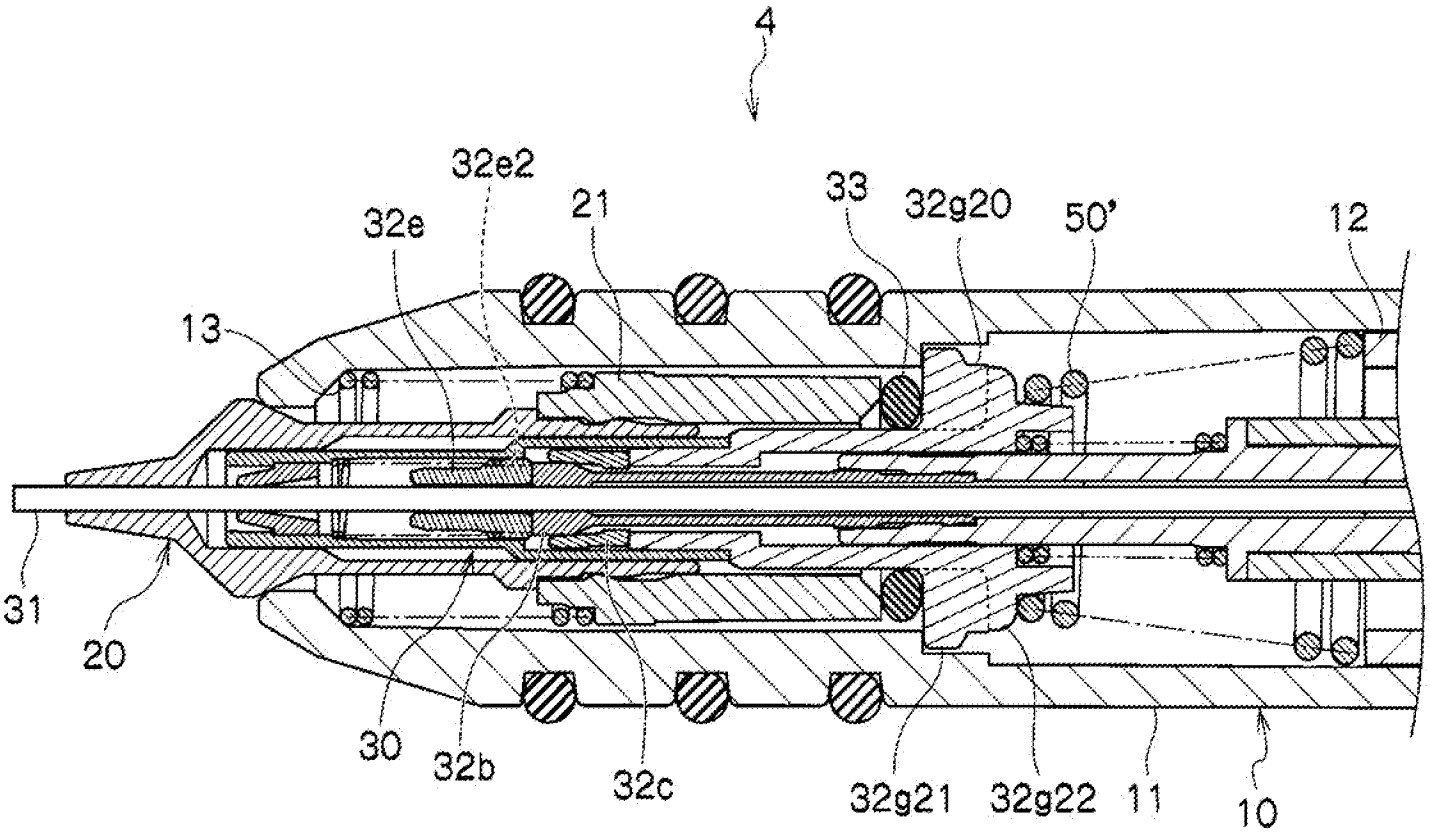
FIG. 14 is a cross-sectional view illustrating a main part of another example of the writing utensil according to the invention.

In the writing utensil 4 illustrated in FIG. 14, the back-and-forth member 40 is removed from the writing utensil 1, and the writing core urge member 50 is replaced by a writing core urge member 50'.

The writing core urge member 50' is a compression coil spring which is decreased in diameter forward, and directly urges the writing core 30 forward while the rear end thereof is received by the front end of the rear shaft tube 12 and the front end thereof is brought into contact with the writing core support portion **32*g*20**.

Thus, even in the writing utensil 4 illustrated in FIG. 14, it is possible to prevent the pencil lead 31 from being bent by moving the writing core 30 backward against the urging force of the writing core urge member 50' when an excessive backward pressing force is applied to the pencil lead 31.

Further, the core powder escapes in the axial direction through the core powder escape groove **32*e*2 by substantially the same mechanism as the writing utensils 1 and 2. Accordingly, it is possible to reduce an operation error caused by the fixing of the core powder and to reduce an operation sound generated when the holder 20 and the spring receiving portion 21 move backward by the buffer material 33**.

In addition, the movement direction conversion mechanism (for example, the cam slant face **20*a*** or the like) may have a structure other than the example illustrated in the drawings as long as the holder is moved forward relative to the shaft tube and the writing core by the force applied to the holder in the shaft tube outward radial direction.

Further, according to the above-described embodiment, the plurality of (six in the example illustrated in the drawings) core powder escape grooves **32*e*2 is provided in the outer periphery of the sliding cylinder 32*e* as a particularly desirable example. However, as another example, the core powder escape groove 32*e*2** may be provided at a single position or a plurality of positions other than the number illustrated in the drawings.

Further, according to the above-described embodiment, the core powder escape groove **32*e*2 is provided in the slide contact surface with respect to the holding cylinder 32*g* at the rear portion of the sliding cylinder 32*e* so as to particularly effectively release the pencil lead. However, as another example, the front portion (specifically, the front portion of the enlarged portion 32*e*1 in FIG. 3) of the sliding cylinder 32*e* may be also provided with a groove which is pierced forward while being continuous to the core powder escape groove 32*e*2**.

Further, according to the above-described embodiment, the sliding cylinder **32*e* and the core powder escape groove 32*e*2 are provided in the mechanical pencil which moves the holder 20, 20', or 20" forward and backward. However, as another example, the sliding cylinder 32*e*** may be provided between the core breaker and the chuck in a mechanical pencil without a holder (for example, the invention disclosed in Japanese Patent Application Laid-Open (JP-A) No. 2010-201813 and Japanese Patent Application Laid-Open (JP-A) No. 2010-094954) or a mechanical pencil refill of a multi-functional writing utensil (for example, the invention disclosed in Japanese Patent Application Laid-Open (JP-A) No. 2008-126596).

Further, the buffer material 33 of the above-described embodiment may be provided between a middle shaft (2) and a pressing portion (3a) in, for example, the invention disclosed in Japanese Utility Model Application Publication (JP-U) No. 63-180283. Further, the buffer material 33 may be provided so as to be pressed and contracted by a holder moving backward in a writing utensil (including a ballpoint pen or a felt pen) in which a holder covering a writing core moves forward and backward relative to a shaft tube.

Further, according to the above-described embodiment, the spring receiving portion 21 which is integrated with the holder 20 is received by the buffer material 33. However, as another example, a structure may be employed in which the holder 20 and the spring receiving portion 21 are formed as a single member and the single member is received by the buffer material 33 or a structure may be employed in which the spring receiving portion 21 is removed from the above-described structure and the outer periphery of the rear end of the holder 20 is provided with a protrusion receiving the holder urge member 13 so that the holder 20 is directly received by the buffer material 33.

EXPLANATION OF REFERENCE NUMERALS

1, 2, 3, 4: writing utensil
10, 10', 10": shaft tube
11*c*: step portion
11*a*: front opening
13: holder urge member
20, 20', 20": holder
20*a*, 11*a*', 21": cam slant face
21: spring receiving portion
30: writing core
31: pencil lead
32: pencil lead delivering mechanism
32*a*: core tank
32*b*: chuck
32*c*: clutch ring
32*d*: core breaker
32*e*: sliding cylinder
32*e*1: enlarged portion
32*e*2: core powder escape groove
32*f*: sliding cylinder urge member
32*g*: holding cylinder
32*g*1: front holding portion
32*g*2: rear holding portion
32*g*12: front contact portion
32*g*20: writing core support portion
32*g*22: contact portion
32*h*: core tank urge member
33: buffer material
40: back-and-forth member
50: writing core urge member

What is claimed is:

1. A writing utensil comprising:

a shaft tube;

a holder which is inserted through a front opening of the shaft tube and protrudes forward from a front end of the shaft tube;

a writing core which is inserted through the holder while coming into contact with an inner peripheral surface of the holder and is supported by the shaft tube so as to protrude forward from a front end of the holder; and a movement direction conversion mechanism which is provided between the shaft tube and the holder and moves the holder forward relative to the shaft tube and the writing core by a force applied to the holder in the shaft tube outward radial direction.

2. The writing utensil according to claim 1, wherein in the movement direction conversion mechanism, a cam slant face is provided in at least one side of the shaft tube and the holder, the holder engages with the shaft tube so as to be movable forward and backward through the cam slant face, and the cam slant face is slanted to come into slide contact with the other side by the force applied to the holder in the shaft tube outward radial direction so as to move the holder forward.

3. The writing utensil according to claim 2, wherein the cam slant face is formed in the outer peripheral surface of the holder so as to be increased in diameter forward.

4. The writing utensil according to claim 1, wherein a holder urge member is provided so as to urge the holder backward relative to the shaft tube.

5. The writing utensil according to claim 1, wherein a buffer material is provided so as to be elastically deformed while receiving the holder moving backward.

6. The writing utensil according to claim 1, wherein a writing core urge member which urges the writing core forward relative to the shaft tube is provided inside the shaft tube and the writing core moves backward against the urging force of the writing core urge member due to a backward force of a predetermined writing pressure or more.

7. The writing utensil according to claim 1, wherein the writing core is a mechanical pencil writing core which includes a pencil lead and a pencil lead delivering mechanism holding the pencil lead so that the pencil lead is able to be delivered, and is supported inside the shaft tube so that the delivered pencil lead is inserted through the holder.

8. The writing utensil according to claim 7, wherein the pencil lead delivering mechanism includes a chuck which moves a clipped pencil lead forward and releases the clipped pencil lead, a core breaker which holds the pencil lead inserted through the chuck at a front position separated from the chuck, a sliding cylinder which moves forward and backward while covering the outer periphery of the pencil lead between the chuck and the core breaker, and an urge member that urges the sliding cylinder backward relative to the core breaker, wherein the sliding cylinder is moved forward and backward along with the chuck, and the pencil lead is delivered to a front position of the core breaker by the clipping operation, the releasing operation, and the forward and backward movement operation of the chuck, and wherein an outer peripheral surface of the sliding cylinder is provided with a core powder escape groove which is pierced in the axial direction.

* * * * *